US011423836B2

(12) United States Patent
Kwon et al.

(10) Patent No.: US 11,423,836 B2
(45) Date of Patent: Aug. 23, 2022

(54) DISPLAY DEVICE HAVING IMPROVED DISPLAY QUALITY AND METHOD OF DRIVING THE SAME

(71) Applicant: SAMSUNG DISPLAY CO., LTD., Yongin-si (KR)

(72) Inventors: Tae Hoon Kwon, Yongin-si (KR); Ji Hyun Ka, Yongin-si (KR); Min Ku Lee, Yongin-si (KR); Seung Ji Cha, Yongin-si (KR); Hyun Uk Oh, Yongin-si (KR); Jin Tae Jeong, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/170,554

(22) Filed: Feb. 8, 2021

(65) Prior Publication Data

US 2021/0166626 A1 Jun. 3, 2021

Related U.S. Application Data

(63) Continuation of application No. 15/885,611, filed on Jan. 31, 2018, now Pat. No. 10,916,191.

(30) Foreign Application Priority Data

Feb. 13, 2017 (KR) ..... 10-2017-0019533
Jul. 3, 2017 (KR) ..... 10-2017-0084370

(51) Int. Cl.
*G09G 3/30* (2006.01)
*G09G 3/3233* (2016.01)
(Continued)

(52) U.S. Cl.
CPC ..... *G09G 3/3233* (2013.01); *G09G 3/20* (2013.01); *G09G 3/2003* (2013.01);
(Continued)

(58) Field of Classification Search
CPC .. G09G 3/2003; G09G 3/2018; G09G 3/3233; G09G 2300/0426;
(Continued)

(56) References Cited

U.S. PATENT DOCUMENTS 7,733,299 B2 6/2010 Higashi
9,024,944 B2 5/2015 Chen et al.
(Continued)

FOREIGN PATENT DOCUMENTS

CN 102625132 A 8/2012
CN 106128357 A 11/2016
(Continued)

OTHER PUBLICATIONS

EPO Extended Search Report dated Jun. 7, 2018, for corresponding European Patent Application No. 18156542.5 (11 pages).

*Primary Examiner* — Sanghyuk Park
(74) *Attorney, Agent, or Firm* — Lewis Roca Rothgerber Christie LLP

(57) ABSTRACT

A display device including a first pixel area including first pixels, a second pixel area including second pixels, a third pixel area including third pixels, and a display driver configured to control image display operations of the first pixel area, the second pixel area, and the third pixel area according to a first mode or a second mode, wherein the first pixel area includes a first sub-pixel area, and a second sub-pixel area between the first sub-pixel area and the second pixel area, and wherein the first sub-pixel area is configured to display a black image in the first mode, and the second sub-pixel area is configured to display a dummy image.

20 Claims, 20 Drawing Sheets

(51) Int. Cl.
*G09G 3/20* (2006.01)
*G09G 3/3266* (2016.01)
*G09G 3/3275* (2016.01)

(52) U.S. Cl.
CPC ..... *G09G 3/2018* (2013.01); *G09G 3/3266* (2013.01); *G09G 3/3275* (2013.01); *G09G 2300/0426* (2013.01); *G09G 2300/0452* (2013.01); *G09G 2310/0232* (2013.01); *G09G 2310/08* (2013.01); *G09G 2320/0626* (2013.01); *G09G 2320/0686* (2013.01); *G09G 2330/021* (2013.01); *G09G 2354/00* (2013.01)

(58) Field of Classification Search
CPC ..... G09G 2300/0452; G09G 3/3266; G09G 2330/021; G09G 2320/0626; G09G 2354/00
See application file for complete search history.

(56) References Cited

U.S. PATENT DOCUMENTS

| | | | | |
|---|---|---|---|---|
| 9,501,975 | B2 | 11/2016 | Eom et al. | |
| 10,043,492 | B2 | 8/2018 | Woo et al. | |
| 10,684,654 | B2 | 6/2020 | Shin et al. | |
| 2007/0024531 | A1 | 2/2007 | Higashi | |
| 2009/0284502 | A1* | 11/2009 | Hayafuji | G09G 3/2025 345/205 |
| 2010/0007656 | A1* | 1/2010 | Okamoto | G09G 3/3233 345/214 |
| 2010/0066752 | A1 | 3/2010 | Watanuki | |
| 2010/0141693 | A1 | 6/2010 | Lee et al. | |
| 2011/0037784 | A1 | 2/2011 | Shiomi | |
| 2011/0057961 | A1* | 3/2011 | Tsuru | G09G 3/342 345/89 |
| 2014/0043380 | A1 | 2/2014 | Ichioka et al. | |
| 2014/0104439 | A1 | 4/2014 | Tatsumi | |
| 2014/0275852 | A1 | 9/2014 | Hong et al. | |
| 2016/0163256 | A1 | 6/2016 | Hochman et al. | |
| 2018/0075797 | A1* | 3/2018 | Park | G09G 3/2092 |

FOREIGN PATENT DOCUMENTS

| | | | |
|---|---|---|---|
| EP | 0618471 | A2 | 10/1994 |
| JP | 3115176 | U | 9/2005 |
| KR | 10-2013-0136338 | A | 12/2013 |
| KR | 10-2017-0062876 | A | 6/2017 |
| TW | 201441998 | A | 11/2014 |

* cited by examiner

DISPLAY DEVICE HAVING IMPROVED DISPLAY QUALITY AND METHOD OF DRIVING THE SAME

CROSS-REFERENCE TO RELATED APPLICATIONS

This application is a continuation of U.S. patent application Ser. No. 15/885,611, filed Jan. 31, 2018, which claims priority to and the benefit of Korean Patent Application No. 10-2017-0019533, filed Feb. 13, 2017 and Korean Patent Application No. 10-2017-0084370, filed Jul. 3, 2017, the entire content of all of which is incorporated herein by reference.

BACKGROUND

1. Field

Aspects of embodiments of the present disclosure relate to a display device and a method of driving the same.

2. Description of Related Art

Currently, various electronic devices that may be directly worn on the human body are being developed. Such devices are generally referred to as wearable electronic devices.

Particularly, a head mounted display device (hereinafter, referred to as "HMD"), which is an example of such wearable electronic devices, may display realistic images, thus providing a high degree of immersion. As such, the HMD may be used for a variety of purposes, for example, for watching movies.

SUMMARY

Aspects of embodiments of the present disclosure are directed to a display device having improved display quality, and a method of driving the display device.

According to an embodiment of the present disclosure there is provided a display device including: a first pixel area including first pixels; a second pixel area including second pixels; a third pixel area including third pixels; and a display driver configured to control image display operations of the first pixel area, the second pixel area, and the third pixel area according to a first mode or a second mode, wherein the first pixel area includes a first sub-pixel area, and a second sub-pixel area between the first sub-pixel area and the second pixel area, and wherein the first sub-pixel area is configured to display a black image in the first mode, and the second sub-pixel area is configured to display a dummy image.

In some embodiments, the second pixel area is between the first pixel area and the third pixel area.

In some embodiments, the display driver is configured to display a valid image via the second pixel area in the first mode, and to display a valid image via the first pixel area, the second pixel area, and the third pixel area in the second mode.

In some embodiments, the first pixel area includes a plurality of first pixel areas on a side of the second pixel area.

In some embodiments, the second sub-pixel area includes a first pixel group and a second pixel group, each of which includes first pixels, and the first pixel group and the second pixel group are configured to alternately emit light in the first mode.

In some embodiments, the second sub-pixel area is configured to repeatedly perform, in the first mode, a light-emitting operation and a non-light-emitting operation on an at least one horizontal line basis.

In some embodiments, the second sub-pixel area includes a first pixel group and a second pixel group, each of which includes first pixel units, each of the first pixel units includes a plurality of first pixels, and the first pixel group and the second pixel group are configured to alternately emit light in the first mode.

In some embodiments, each of the first pixel units includes one first pixel configured to emit red light, one first pixel configured to emit blue light, and two first pixels configured to emit green light.

In some embodiments, each of the first pixel units includes one first pixel configured to emit red light, one first pixel configured to emit green light, and two first pixels configured to emit blue light.

In some embodiments, first pixels of the second sub-pixel area are configured to emit light and then to sequentially perform a non-light-emitting operation on an at least one pixel row basis in the first mode.

In some embodiments, the first pixels of the second sub-pixel area are configured to perform the non-light-emitting operation in a sequence from a pixel row farthest from the second pixel area to a pixel row closest to the second pixel area in the first mode.

In some embodiments, the third pixel area includes a third sub-pixel area, and a fourth sub-pixel area between the third sub-pixel area and the second pixel area, and the third sub-pixel area is configured to display a black image in the first mode, and the fourth sub-pixel area is configured to display a dummy image.

In some embodiments, a luminance of the dummy image is reduced in discrete levels in a direction away from the second pixel area.

According to an embodiment of the present disclosure there is provided a method of driving a display device, the method including: displaying, in a second mode, a valid image via a first pixel area including first pixels, a second pixel area including second pixels, and a third pixel area including third pixels; and displaying, when a driving mode of the display device is changed from the second mode to a first mode, a valid image via the second pixel area, displaying a black image via a first sub-pixel area of the first pixel area, and displaying a dummy image via a second sub-pixel area of the first pixel area.

In some embodiments, the second pixel area is between the first pixel area and the third pixel area.

In some embodiments, the first pixel area includes a plurality of first pixel areas at a side of the second pixel area.

In some embodiments, the second sub-pixel area includes a first pixel group and a second pixel group each of which includes first pixels, and the first pixel group and the second pixel group are configured to alternately emit light in the first mode.

In some embodiments, the second sub-pixel area is configured to repeatedly perform, in the first mode, a light-emitting operation and a non-light-emitting operation on an at least one horizontal line basis.

In some embodiments, the second sub-pixel area includes a first pixel group and a second pixel group each of which includes first pixel units, and each of the first pixel units includes a plurality of first pixels, and the first pixel group and the second pixel group are configured to alternately emit light in the first mode.

In some embodiments, each of the first pixel units includes one first pixel configured to emit red light, one first pixel configured to emit blue light, and two first pixels configured to emit green light.

In some embodiments, each of the first pixel units includes one first pixel configured to emit red light, one first pixel configured to emit green light, and two first pixels configured to emit blue light.

In some embodiments, first pixels of the second sub-pixel area are configured to emit light and then to sequentially perform a non-light-emitting operation on an at least one pixel row basis in the first mode.

In some embodiments, the first pixels of the second sub-pixel area are configured to perform, in the first mode, the non-light-emitting operation in a sequence from a pixel row farthest from the second pixel area to a pixel row closest to the second pixel area.

In some embodiments, when the driving mode of the display device is converted from the second mode to the first mode, a black image is displayed on a third sub-pixel area of the third pixel area, and a dummy image is displayed on a fourth sub-pixel area of the third pixel area.

In some embodiments, the display device is configured to enter the first mode when the display device is mounted to a wearable device, and the display device is configured to enter the second mode when the display device is removed from the wearable device.

In some embodiments, a luminance of the dummy image is reduced in discrete levels in a direction away from the second pixel area.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the figures, dimensions may be exaggerated for clarity of illustration. Like reference numerals refer to like elements throughout.

DETAILED DESCRIPTION

Figure 1A:
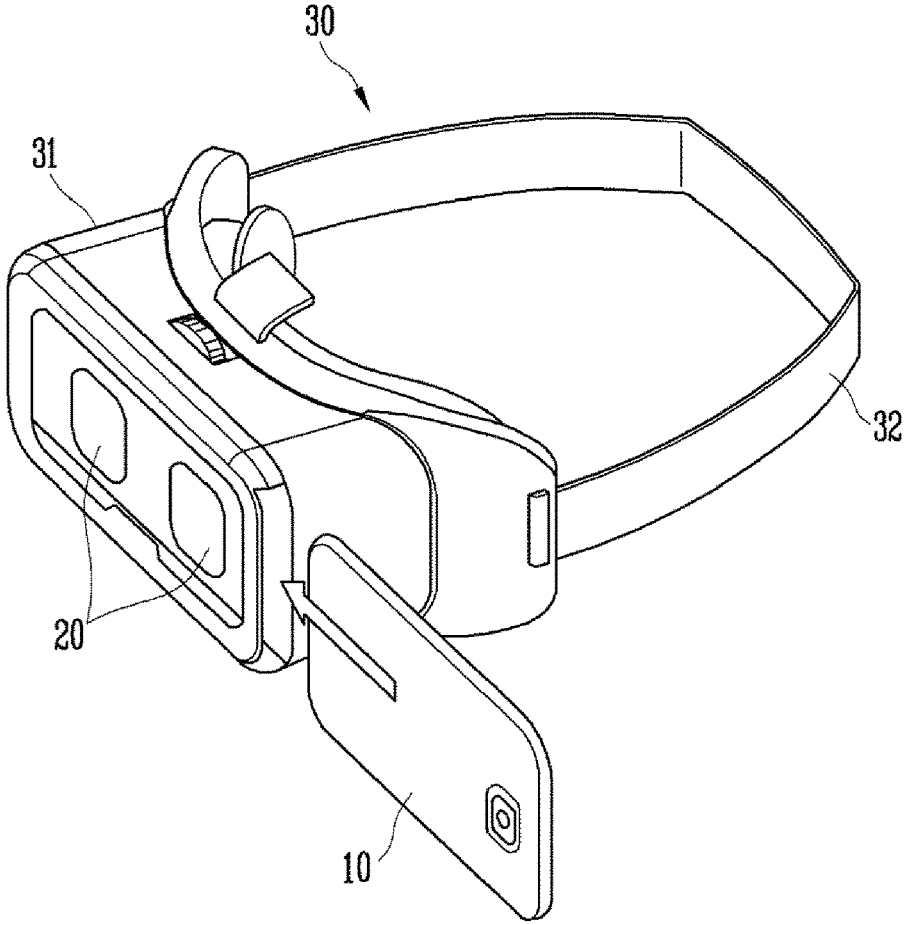
FIGS. 1A-1C are diagrams illustrating a process of mounting a display device, in accordance with an embodiment of the present disclosure, to a wearable device.

Details of various embodiments are included in the detailed descriptions and figures.

Aspects and features of the present disclosure, and methods for achieving the same will be made more clear with reference to embodiments described later in detail together with the accompanying drawings. However, it is to be noted that the present disclosure is not limited to the embodiments but can be embodied in various other ways that may be suitable. Furthermore, in drawings, portions unrelated to the present disclosure have been omitted to clarify the description of the present invention, and the same reference numerals are used throughout the different drawings to designate the same or similar components.

Hereinafter, a display device and a method of driving the display device in accordance with embodiments of the present disclosure will be described with reference to the attached drawings pertaining to the embodiments of the present disclosure.

Figure 1B:
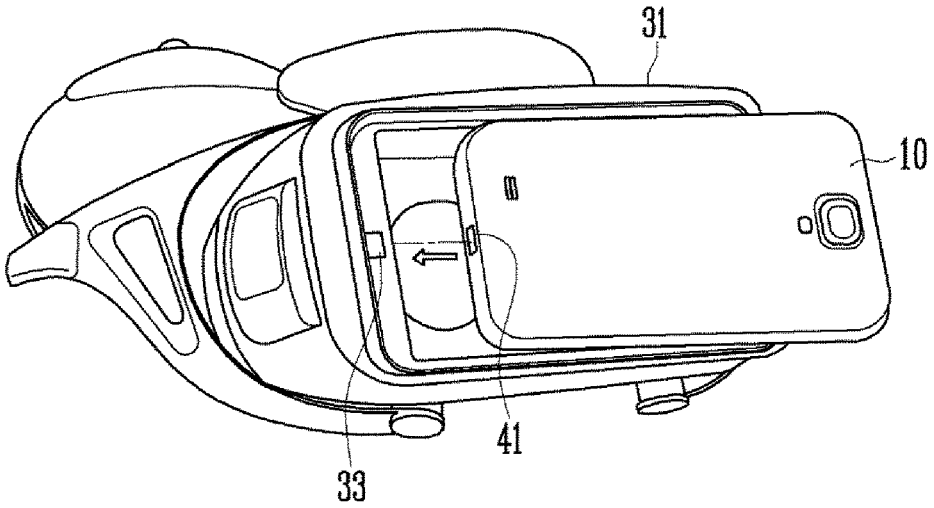
Figure 1C:
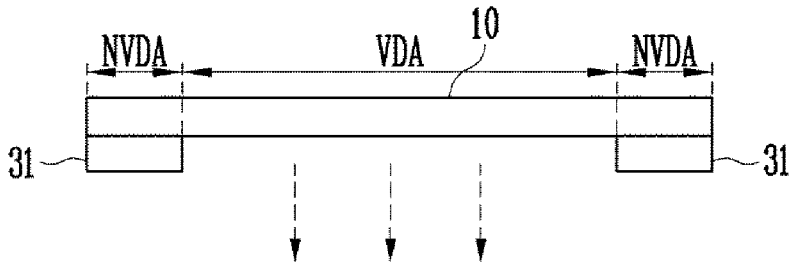

FIGS. 1A to 1C are diagrams illustrating a process of mounting a display device 10 in accordance with an embodiment of the present disclosure to a wearable device 30.

Referring to FIGS. 1A and 1B, the wearable device 30 in accordance with an embodiment of the present disclosure may include a frame 31.

The frame 31 may be coupled with a band 32. A user may wear the frame 31 on his/her head using the band 32. The frame 31 may have a structure allowing the display device 10 to be removably mounted thereto.

The display device 10, which may be mounted to the wearable device 30, may be for example a smartphone.

However, the display device 10 in accordance with an embodiment of the present disclosure is not limited to a smartphone, and it may be not only a smartphone but also any one of electronic devices such as a table PC, an electronic book reader, a computer, a workstation, a personal digital assistant (PDA), a portable multimedia player (PMP), and a camera, which may be mounted to the wearable device 30 and provided with a display unit.

For example, when the display device 10 is mounted to the frame 31, a connector 41 of the display device 10 may be electrically coupled with a connector 33 of the frame 31, thus making communication between the frame 31 and the display device 10 possible.

To control the display device 10 mounted to the frame 31, the wearable device 30 may include at least one of a touch sensor, a button, and a wheel key.

If the display device 10 is mounted to the wearable device 30, the display device 10 may be operated as an HMD. In other words, in the case where the display device 10 is mounted to the wearable device 30, the display device 10 may be driven in a first mode (e.g., a virtual reality (VR) mode). In the case where the display device 10 is removed from the wearable device 30, the display device 10 may be driven in a second mode (e.g., a normal mode).

When the display device 10 is mounted to the wearable device 30, the driving mode of the display device 10 may be automatically converted (e.g., changed) to the first mode or may be converted to the first mode by a setting operation of the user.

When the display device 10 is removed from the wearable device 30, the driving mode of the display device 10 may be automatically converted to the second mode or may be converted to the second mode by a setting operation of the user.

The wearable device 30 may include lenses 20 corresponding to the two eyes of the user. Each lens 20 may be embodied by a fish-eye lens or a wide-angle lens so as to increase a field of view (FOV) of the user.

If the display device 10 is fastened to the frame 31, the user may see a display area of the display device 10 through the lenses 20. Hence, this may have the same effect as when the user watches a large screen spaced apart from him/her by a set or predetermined distance.

When the display device 10 is mounted to the wearable device 30, the distance between the eyes of the user and the display device 10 is relatively short. Therefore, the display area of the display device 10 may be divided into an area having high visibility and an area having low visibility.

Referring to FIG. 1C, of the entire display area of the display device 10, the area having high visibility will be referred to as a visible area VDA, and the area having low visibility will be referred to as a non-visible area NVDA.

In this case, a central portion of the display area that corresponds to the positions of the lenses 20 may be the visible area VDA, and a remaining portion of the display area other than the central portion may be the non-visible area NVDA.

When the display device 10 is mounted to the wearable device 30 and driven in the first mode, a valid image (e.g., a non-dummy image) may be disposed on the visible area VDA. The other non-visible area NVDA may be maintained in a non-light-emitting state and may display a black image.

In the case where a valid image is displayed on only some area (VDA) of the display area, the frame frequency may be increased, whereby a more lively image may be displayed.

When the display device 10 is removed from the wearable device 30 and driven in the second mode, the entirety of the display area of the display device 10 may be visible to the user. In other words, when the display device 10 is removed from the wearable device 30, the entirety of the display area may become a visible area VDA. In this case, a valid image may be displayed on the entirety of the display area of the display device 10.

As such, the display device 10 in accordance with an embodiment of the present disclosure may be driven in different ways corresponding to the first mode and the second mode. For example, the display device 10 may display a valid image on areas set in different forms corresponding to the respective modes.

In the case where the display device 10 is mounted to the wearable device 30, some area (e.g., the non-visible area NVDA) of the display area may be covered with the frame 31.

In this case, even though a dummy image is displayed on some area of the non-visible area NVDA, it may not be completely visible to the user.

As shown in embodiments of the present disclosure, when the display device 10 is used with the wearable device 30, the user may enjoy various types of images. However, as described above, because an area in which a valid image is displayed in the first mode differs from an area in which a valid image is displayed in the second mode, there may be a problem in that, when the driving mode of the display device 10 is converted, a boundary line between the visible area and the non-visible area is visible to the user.

Therefore, it is desirable to solve the problem of the boundary line being visible to the user in displaying an image on the display device 10, which can be mounted to the wearable device 30.

Figure 2:
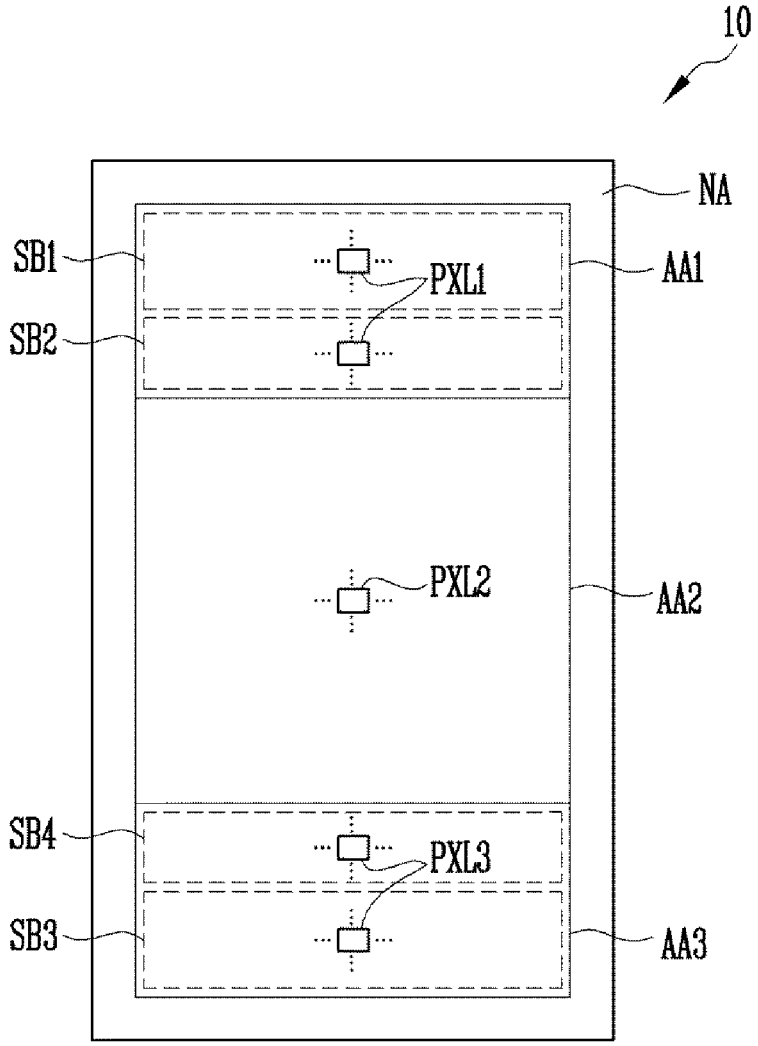
FIG. 2 is a diagram illustrating pixel areas of the display device in accordance with an embodiment of the present disclosure.

FIG. 2 is a diagram illustrating pixel areas of the display device 10 in accordance with an embodiment of the present disclosure.

Referring to FIG. 2, the display device 10 in accordance with an embodiment of the present disclosure may include pixel areas AA1, AA2, and AA3 and a peripheral area NA.

A plurality of pixels PXL1, PXL2, and PXL3 are disposed in the pixel areas AA1, AA2, and AA3. Hence, an image (e.g., a predetermined image) may be displayed on the pixel areas AA1, AA2, and AA3. Thus, the pixel areas AA1, AA2, and AA3 may make up a display area.

Components (e.g., lines or the like) for driving the pixels PXL1, PXL2, and PXL3 may be disposed in the peripheral area NA. The peripheral area NA may refer to the non-display area because the pixels PXL1, PXL2 or PXL3 are not present therein.

For example, the peripheral area NA may be formed outside the pixel areas AA1, AA2, and AA3, and may have a shape enclosing at least some of the pixel areas AA1, AA2, and AA3.

The pixel areas AA1, AA2, and AA3 may include a first pixel area AA1, a second pixel area AA2 disposed on one side of the first pixel area AA1, and a third pixel area AA3 disposed on one side of the second pixel area AA2. For example, the first pixel area AA1, the second pixel area AA2, and the third pixel area AA3 may be successively disposed.

The second pixel area AA2 may be located between the first pixel area AA1 and the third pixel area AA3. Each of the first and third pixel areas AA1 and AA3 may have an area smaller than that of the second pixel area AA2.

The second pixel area AA2 may correspond to the visible area VDA shown in FIG. 1C. The first pixel area AA1 and the third pixel area AA3 may correspond to the non-visible area NVDA.

In other words, when the display device 10 is driven in the first mode, the user may not see images displayed on the first and third pixel areas AA1 and AA3, and may see only an image displayed on the second pixel area AA2.

On the other hand, when the display device 10 is driven in the second mode, the user may see images displayed on the first to third pixel areas AA1, AA2, and AA3.

The pixels PXL1, PXL2, and PXL3 may include first pixels PXL1, second pixels PXL2, and third pixels PXL3.

For example, the first pixels PXL1 may be disposed in the first pixel area AA1. The second pixels PXL2 may be disposed in the second pixel area AA2. The third pixels PXL3 may be disposed in the third pixel area AA3.

The pixels PXL1, PXL2, and PXL3 may emit light at a luminance (e.g., a predetermined luminance) under the control of drivers. For this operation, each of the pixels PXL1, PXL2, and PXL3 may include a light-emitting element (e.g., an organic light-emitting diode).

In FIG. 2, there is illustrated an example in which the first pixel area AA1, the second pixel area AA2, and the third pixel area AA3 have the same or substantially the same width, but the present disclosure is not limited to this.

For example, the first pixel area AA1 and/or the third pixel area AA3 may have a shape in which the width thereof is reduced in a direction away from the second pixel area AA2.

In some embodiments, the width of the first pixel area AA1 and/or the third pixel area AA3 may be less than that of the second pixel area AA2. In this case, a plurality of first pixel areas AA1 and/or a plurality of third pixel areas AA3 may be disposed in a vertical or horizontal direction.

When the display device 10 is driven in the first mode, a valid image may be displayed on the second pixel area AA2. In this case, because the first pixel area AA1 and the third pixel area AA3 are areas that are invisible to the user, they may generally display black images.

In other words, when the display device 10 is driven in the first mode, the second pixels PXL2 that are disposed in the second pixel area AA2 may perform a normal light-emitting operation in response to data signals, and the first and third pixels PXL1 and PXL3 that are disposed in the first and third pixel areas AA1 and AA3 may be set to a non-light emitting state.

In this case, characteristics of drive transistors included in the first and third pixels PXL1 and PXL3 may differ from those of drive transistors included in the second pixels PXL2.

Therefore, when the driving mode of the display device 10 is converted from the first mode to the second mode, a deviation in luminance between the second pixel area AA2 and the other pixel areas AA1 and AA3 may be caused depending on a deviation in characteristics of the drive transistors disposed in the first to third pixel areas AA1, AA2, and AA3.

In accordance with an embodiment of the present disclosure, when the display device 10 is driven in the first mode, a set or predetermined dummy image may be displayed on a boundary area SB2 of the first pixel area AA1 that is adjacent to the second pixel area AA2, whereby the characteristics of the drive transistors disposed in the boundary area SB2 may be adjusted to be close to those of the drive transistors disposed in the second pixel area AA2.

Consequently, gradual deviations in luminance between a non-boundary area SB1, the boundary area SB2, and the second pixel area AA2 may be formed. As a result, a phenomenon in which a boundary line is visible to the user may be mitigated.

For example, the first pixel area AA1 may include a first sub-pixel area SB1 and a second sub-pixel area SB2. The second sub-pixel area SB2 may be disposed adjacent to the second pixel area AA2 and designated as a boundary area.

The first sub-pixel area SB1 may be designated as a non-boundary area and disposed outside the second sub-pixel area SB2.

For example, the second sub-pixel area SB2 may be disposed in the first sub-pixel area SB1 and the second pixel area AA2.

In the first mode, the first sub-pixel area SB1 may display a black image, and the second sub-pixel area SB2 may display a dummy image.

For this operation, first pixels PXL1 included in the first sub-pixel area SB1 may be maintained in a non-light-emitting state, and first pixels PXL1 included in the second sub-pixel area SB2 may emit light according to a set or predetermined pattern. The light-emitting pattern of the first pixels PXL1 included in the second sub-pixel area SB2 will be described in detail later herein.

In the case of the third pixel area AA3, the phenomenon in which a boundary line is visible to the user may be mitigated in the same manner as that described with reference to the first pixel area AA1.

That is, when the display device 10 is driven in the first mode, a set or predetermined dummy image may be displayed on a boundary area SB4 of the third pixel area AA3 that is adjacent to the second pixel area AA2.

For example, the third pixel area AA3 may include a third sub-pixel area SB3 and a fourth sub-pixel area SB4. The fourth sub-pixel area SB4 may be disposed adjacent to the second pixel area AA2 and designated as a boundary area.

The third sub-pixel area SB3 may be designated as a non-boundary area and disposed outside the fourth sub-pixel area SB4.

For example, the fourth sub-pixel area SB4 may be disposed in the third sub-pixel area SB3 and the second pixel area AA2.

In the first mode, the third sub-pixel area SB3 may display a black image, and the fourth sub-pixel area SB4 may display a dummy image.

For this operation, third pixels PXL3 included in the third sub-pixel area SB3 may be maintained in a non-light-emitting state, and third pixels PXL3 included in the fourth sub-pixel area SB4 may emit light according to a set or predetermined pattern. The light-emitting pattern of the third pixels PXL3 included in the fourth sub-pixel area SB4 will be described in detail later herein.

Figure 3:
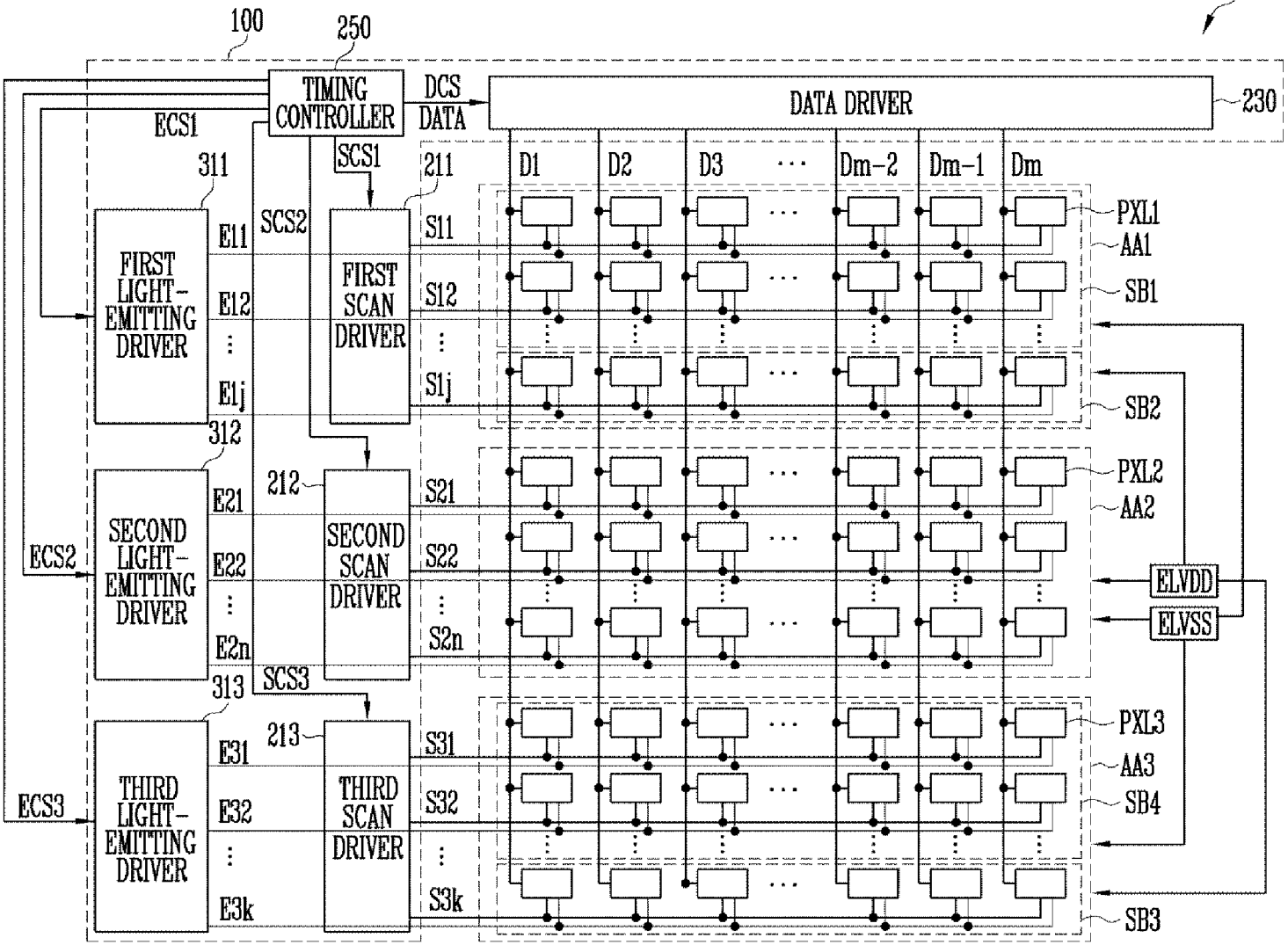
FIG. 3 is a diagram illustrating in detail the configuration of the display device in accordance with an embodiment of the present disclosure.

FIG. 3 is a diagram illustrating in detail the configuration of the display device 10 in accordance with an embodiment of the present disclosure.

Referring to FIG. 3, the display device 10 in accordance with an embodiment of the present disclosure may include pixel areas AA1, AA2, and AA3, and a display driver 100.

The display driver 100 may control image display operations of the pixel areas AA1, AA2, and AA3 in conformity with the driving mode of the display device 10.

For instance, the display driver 100 may display a valid image on the second pixel area AA2 in the first mode. In this case, the display driver 100 may display a black image on each of the first sub-pixel area SB1 and the third sub-pixel area SB3 and display a dummy image having a set or predetermined pattern on each of the second sub-pixel area SB2 and the fourth sub-pixel area SB4.

The display driver 100 may display a valid image on the entire pixel areas AA1, AA2, and AA3 in the second mode.

In detail, the display driver 100 may include a first scan driver 211, a second scan driver 212, a third scan driver 213, a first light-emitting driver 311, a second light-emitting driver 312, a third light-emitting driver 313, a data driver 230, and a timing controller 250.

The first pixels PXL1 may be disposed in the first pixel area AA1 that is defined by first scan lines S11 to S1*j*, first light-emitting control lines E11 to E1*j*, and data lines D1 to Dm.

When scan signals are supplied from the first scan lines S11 to S1*j*, the first pixels PXL1 may be supplied with data signals from the data lines D1 to Dm.

For example, in the first mode, the first pixels PXL1 disposed in the first sub-pixel area SB1 may be supplied with black data signals, and the first pixels PXL1 disposed in the second sub-pixel area SB2 may be supplied with dummy data signals. Consequently, the first sub-pixel area SB1 may display a black image, and the second sub-pixel area SB2 may display a dummy image.

In the second mode, both the first pixels PXL1 disposed in the first sub-pixel area SB1 and the first pixels PXL1 disposed in the second sub-pixel area SB2 may be supplied with valid data signals. Consequently, both the first sub-pixel area SB1 and the second sub-pixel area SB2 may display valid images.

Each of the first pixels PXL1 may control current flowing from a first power supply ELVDD to a second power supply ELVSS via an organic light-emitting diode in response to a supplied data signal. The organic light-emitting diode may generate light having luminance corresponding to the current.

For example, when each first pixel PXL1 is supplied with a valid data signal or a dummy data signal, current corresponding thereto flows through the corresponding organic light-emitting diode. Thereby, the first pixel PXL1 may emit light at a luminance corresponding to the valid data signal or the dummy data signal.

When each first pixel PXL1 is supplied with a black data signal, current is not supplied to the corresponding organic light-emitting diode, so that the first pixel PXL1 may be set to a non-light-emitting state.

The second pixels PXL2 may be disposed in the second pixel area AA2 that is defined by second scan lines S21 to S2*n*, second light-emitting control lines E21 to E2*n*, and the data lines D1 to Dm.

When scan signals are supplied from the second scan lines S21 to S2*n*, the second pixels PXL2 may be supplied with data signals from the data lines D1 to Dm.

For example, the second pixels PXL2 may be supplied with valid data signals in either the first mode or the second mode. Hence, the second pixels PXL2 may display a valid image.

Each of the second pixels PXL2 may control current flowing from the first power supply ELVDD to the second power supply ELVSS via an organic light-emitting diode in response to a supplied data signal. The organic light-emitting diode may generate light having luminance corresponding to the current.

The third pixels PXL3 may be disposed in the third pixel area AA3 that is defined by third scan lines S31 to S3*k*, third light-emitting control lines E31 to E3*k*, and the data lines D1 to Dm.

When scan signals are supplied from the third scan lines S31 to S3*k*, the third pixels PXL3 may be supplied with data signals from the data lines D1 to Dm.

For example, in the first mode, the third pixels PXL3 disposed in the third sub-pixel area SB3 may be supplied with black data signals, and the third pixels PXL3 disposed in the fourth sub-pixel area SB4 may be supplied with dummy data signals. Consequently, the third sub-pixel area SB3 may display a black image, and the fourth sub-pixel area SB4 may display a dummy image.

In the second mode, both the third pixels PXL3 disposed in the third sub-pixel area SB3 and the third pixels PXL3 disposed in the fourth sub-pixel area SB4 may be supplied with valid data signals. Consequently, both the third sub-pixel area SB3 and the fourth sub-pixel area SB4 may display valid images.

Each of the third pixels PXL3 may control current flowing from the first power supply ELVDD to the second power supply ELVSS via an organic light-emitting diode in response to a supplied data signal. The organic light-emitting diode may generate light having luminance corresponding to the current.

For example, when each third pixel PXL3 is supplied with a valid data signal or a dummy data signal, current corresponding thereto flows through the corresponding organic light-emitting diode. Thereby, the third pixel PXL3 may emit light at a luminance corresponding to the valid data signal or the dummy data signal.

When each third pixel PXL3 is supplied with a black data signal, current is not supplied to the corresponding organic light-emitting diode, so that the third pixel PXL3 may be set to a non-light-emitting state.

For example, each of the first and third pixel areas AA1 and AA3 may have an area smaller than that of the second pixel area AA2.

In this case, the number of first or third pixels PXL1 or PXL3 may be set less than that of the second pixels PXL2. The number of first scan lines S11 to S1*j* or third scan lines S31 to S3*k* may be set less than that of second scan lines S21 to S2*n*.

The first scan driver 211 may supply first scan signals to the first scan lines S11 to S1*j* in response to a first scan driver control signal SCS1 from the timing controller 250.

For example, the first scan driver 211 may sequentially supply first scan signals to the first scan lines S11 to S1*j*. When the first scan signals are sequentially supplied to the first scan lines S11 to S1*j*, the first pixels PXL1 may be sequentially selected on a horizontal line basis.

The second scan driver 212 may supply second scan signals to the second scan lines S21 to S2*n* in response to a second scan driver control signal SCS2 from the timing controller 250.

For example, the second scan driver 212 may sequentially supply second scan signals to the second scan lines S21 to S2*n*. When the second scan signals are sequentially supplied to the second scan lines S21 to S2*n*, the second pixels PXL2 may be sequentially selected on a horizontal line basis.

The third scan driver 213 may supply third scan signals to the third scan lines S31 to S3*k* in response to a third scan driver control signal SCS3 from the timing controller 250.

For example, the third scan driver 213 may sequentially supply third scan signals to the third scan lines S31 to S3*k*. When the third scan signals are sequentially supplied to the third scan lines S31 to S3*k*, the third pixels PXL3 may be sequentially selected on a horizontal line basis.

Here, each of the first, second, and third scan signals may be set to a voltage at which a corresponding transistor can be turned on.

That is, in terms of the entirety of the display device 10, when the display device 10 is driven in the first or second mode, the first pixels PXL1, the second pixels PXL2, and the third pixels PXL3 may be sequentially selected on a horizontal line basis during each frame period.

The first light-emitting driver 311 may supply first light-emitting control signals to the first light-emitting control lines E1*l* to E1*j* in response to a first light-emitting driver control signal ECS1 from the timing controller 250.

For example, the first light-emitting driver 311 may sequentially supply first light-emitting control signals to the first light-emitting control lines E1*l* to E1*j*.

The second light-emitting driver 312 may supply second light-emitting control signals to the second light-emitting control lines E21 to E2*n* in response to a second light-emitting driver control signal ECS2 from the timing controller 250.

For example, the second light-emitting driver 312 may sequentially supply second light-emitting control signals to the second light-emitting control lines E21 to E2*n*.

The third light-emitting driver 313 may supply third light-emitting control signals to the third light-emitting control lines E31 to E3*k* in response to a third light-emitting driver control signal ECS3 from the timing controller 250.

For example, the third light-emitting driver 313 may sequentially supply third light-emitting control signals to the third light-emitting control lines E31 to E3*k*.

Here, the light-emitting control signals may be used to control light-emitting times of the pixels PXL1, PXL2, and PXL3 and may be set to voltages at which corresponding transistors can be turned off.

That is, in terms of the entirety of the display device 10, when the display device 10 is driven in the first or second mode, the first pixels PXL1, the second pixels PXL2, and the third pixels PXL3 may be sequentially supplied with light-emitting control signals on a horizontal line basis during each frame period.

The data driver 230 may supply data signals to the data lines D1 to Dm in response to a data control signal DCS.

For instance, in the first mode, the data driver 230 may supply black data signals to the first pixels PXL1 disposed in the first sub-pixel area SB1 during a period in which scan signals are supplied to the first sub-pixel area SB1. In addition, the data driver 230 may supply dummy data signals to the first pixels PXL1 disposed in the second sub-pixel area SB2 during a period in which scan signals are supplied to the second sub-pixel area SB2.

In the first mode, the data driver 230 may also supply valid data signals to the second pixels PXL2 disposed in the second pixel area AA2 during a period in which scan signals are supplied to the second pixel area AA2.

In the first mode, the data driver 230 may supply black data signals to the third pixels PXL3 disposed in the third sub-pixel area SB3 during a period in which scan signals are supplied to the third sub-pixel area SB3. In addition, the data driver 230 may supply dummy data signals to the third pixels PXL3 disposed in the fourth sub-pixel area SB4 during a period in which scan signals are supplied to the fourth sub-pixel area SB4.

In the second mode, the data driver 230 may supply valid data signals to the respective pixels PXL1, PXL2, and PXL3 disposed in the pixel areas AA1, AA2, and AA3 during a period in which scan signals are supplied to the respective pixel areas AA1, AA2, and AA3.

The timing controller 250 may supply, to the scan drivers 211, 212, and 213, scan driver control signals SCS1, SCS2, and SCS3 generated based on timing signals supplied from an external device.

The first scan driver control signal SCS1 may include a first start signal and clock signals. The first start signal may control timings at which the first scan signals are supplied. The clock signals may be used to shift the first start signal.

The second scan driver control signal SCS2 may include clock signals. The clock signals may be used to shift a first scan signal supplied to the last first scan line S1*j*.

The third scan driver control signal SCS3 may include clock signals. The clock signals may be used to shift a second scan signal supplied to the last second scan line S2*n*.

For example, the clock signals included in the first to third scan driver control signals SCS1 to SCS3 may be the same signal.

The timing controller 250 may supply, to the light-emitting drivers 311, 312, and 313, light-emitting driver control signals ECS1, ECS2, and ECS3 generated based on timing signals supplied from an external device.

The first light-emitting driver control signal ECS1 may include a second start signal and clock signals. The second start signal may control timings at which the first light-emitting control signals are supplied. The clock signals may be used to shift the second start signal.

The second light-emitting driver control signal ECS2 may include clock signals. The clock signals may be used to shift a first light-emitting control signal supplied to the last first light-emitting control line E1*j*.

The third light-emitting driver control signal ECS3 may include clock signals. The clock signals may be used to shift a second light-emitting control signal supplied to the last second light-emitting control line E2*n*.

For example, the clock signals included in first to third light-emitting driver control signals ECS1 to ECS3 may be the same signal.

The timing controller 250 may supply a data control signal DCS to the data driver 230. The timing controller 250 may translate image data input from an external device into image data DATA corresponding to the specifications of the data driver 230, and then supply the image data DATA to the data driver 230.

The data control signal DCS may include a source start signal, a source output enable signal, a source sampling clock, and/or the like. The source start signal may control a point in time at which a data sampling operation of the data driver 230 starts. The source sampling clock may control the sampling operation of the data driver 230 based on a rising or falling edge. The source output enable signal may control the output timing of the data driver 230.

In FIG. 3, there is illustrated an example in which the scan drivers 211, 212, and 213, the light-emitting drivers 311, 312, and 313, the data driver 230, and the timing controller 250 are separately provided, but at least some of the foregoing components may be integrated with each other if desired.

The scan drivers 211, 212, and 213, the light-emitting drivers 311, 312, and 313, the data driver 230, and the timing controller 250 may be implemented using any one of various suitable methods, such as chip on glass, chip on plastic, tape carrier package, and chip on film methods.

In the case where the pixels PXL1, PXL2, and PXL3 have a structure that does not use a light-emitting control signal, the light-emitting drivers 311, 312, and 313, and the light-emitting control lines E1*l* to E1*j*, E21 to E2*n*, and E31 to E3*k* may be omitted.

Figure 4A:
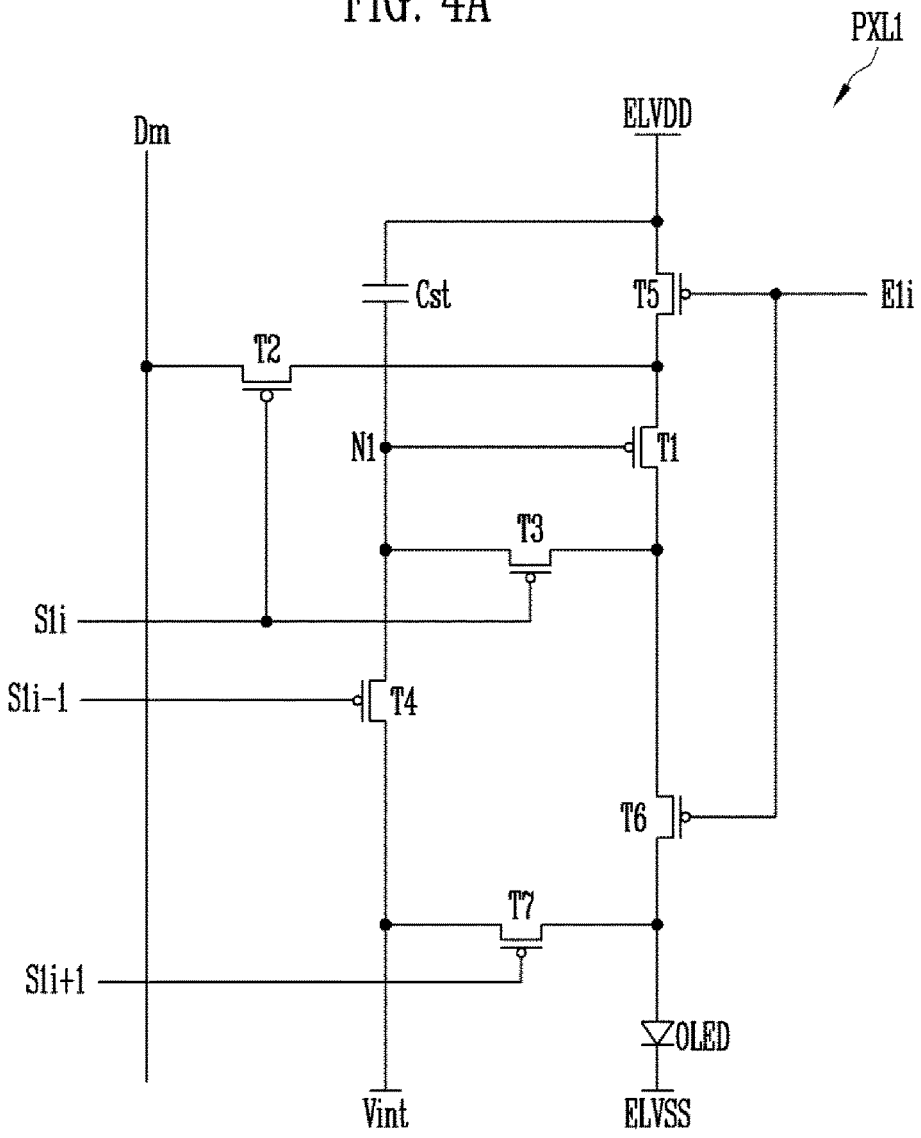
FIGS. 4A-4B are diagrams illustrating an embodiment of a first pixel shown in FIG. 3 and a method of driving the first pixel.
Figure 4B:
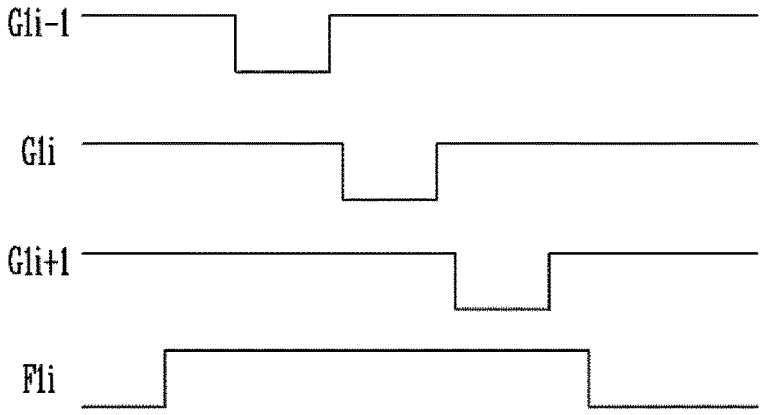

FIGS. 4A and 4B are diagrams illustrating an embodiment of a first pixel shown in FIG. 3 and a method of driving the first pixel.

In FIG. 4A, for the sake of description, a first pixel PXL1 coupled to an m-th data line Dm and an i-th first-scan line S1*i* is illustrated.

Referring to FIG. 4A, the first pixel PXL1 in accordance with an embodiment of the present disclosure may include an organic light-emitting diode (OLED), first to seventh transistors T1 to T7, and a storage capacitor Cst.

An anode of the OLED may be coupled to the first transistor T1 via the sixth transistor T6, and a cathode thereof may be coupled to a second pixel power supply ELVSS. The OLED may emit light having a luminance (e.g., a predetermined luminance) corresponding to current supplied from the first transistor T1.

A first pixel power supply ELVDD may be set to a voltage higher than that of the second pixel power supply ELVSS so that current can flow to the OLED.

The seventh transistor T7 may be coupled between an initialization power supply Vint and the anode of the OLED. A gate electrode of the seventh transistor T7 may be coupled to an i+1-th first-scan line S1*i*+1. When a scan signal is supplied to the i+1-th first-scan line S1*i*+1, the seventh transistor T7 is turned on so that a voltage of the initialization power supply Vint may be supplied to the anode of the OLED. The initialization power supply Vint may be set to a voltage lower than that of a data signal.

The sixth transistor T6 may be coupled between the first transistor T1 and the OLED. A gate electrode of the sixth transistor T6 may be coupled to an i-th first-light-emitting control line E1*i*. The sixth transistor T6 may be turned off when a light-emitting control signal is supplied to the i-th first-light-emitting E1*i*, and may be turned on in other cases.

The fifth transistor T5 may be coupled between the first pixel power supply ELVDD and the first transistor T1. A gate electrode of the fifth transistor T5 may be coupled to the i-th first-light-emitting control line E1*i*. The fifth transistor T5 may be turned off when a light-emitting control signal is supplied to the i-th first-light-emitting E1*i*, and may be turned on in other cases.

A first electrode of the first transistor (T1; drive transistor) may be coupled to the first pixel power supply ELVDD via the fifth transistor T5, and a second electrode thereof may be coupled to the anode of the OLED via the sixth transistor T6. A gate electrode of the first transistor T1 may be coupled to a first node N1. The first transistor T1 may control, in correspondence with a voltage of the first node N1, current flowing from the first pixel power supply ELVDD to the second pixel power supply ELVSS via the OLED.

The third transistor T3 may be coupled between a second electrode of the first transistor T1 and the first node N1. A gate electrode of the third transistor T3 may be coupled to an i-th first-scan line S1*i*. When a scan signal is supplied to the i-th first-scan line S1*i*, the third transistor T3 may be turned on so that the second electrode of the first transistor T1 can be electrically coupled with the first node N1. Therefore, when the third transistor T3 is turned on, the first transistor T1 may be connected in the form of a diode.

The fourth transistor T4 may be coupled between the first node N1 and the initialization power supply Vint. A gate electrode of the fourth transistor T4 may be coupled to an i−1-th first-scan line S1*i*−1. When a scan signal is supplied to the i−1-th first-scan line S1*i*−1, the fourth transistor T4 is turned on so that the voltage of the initialization power supply Vint can be supplied to the first node N1.

The second transistor T2 may be coupled between the m-th data line Dm and the first electrode of the first transistor T1. A gate electrode of the second transistor T2 may be coupled to the i-th first-scan line S1*i*. When a scan signal is supplied to the i-th first-scan line S1*i*, the second transistor T2 may be turned on so that the first electrode of the first transistor T1 can be electrically coupled with the m-th data line Dm.

The storage capacitor Cst may be coupled between the first pixel power supply ELVDD and the first node N1. The storage capacitor Cst may store a voltage corresponding both to a data signal and a threshold voltage of the first transistor T1.

Each of the second pixel PXL2 and the third pixel PXL3 may be embodied by the same circuit or substantially the same as that of the first pixel PXL1. Therefore, detailed description of the second pixel PXL2 or the third pixel PXL3 may not be repeated.

The pixel structure illustrated in FIG. 4A is only one example using the scan line and the light-emitting control line, so that the pixels PXL1, PXL2, and PXL3 of the present disclosure are not limited to the foregoing pixel structure. Substantially, the pixel has a circuit structure capable of supplying current to the OLED, and any one of various well-known structures that are suitable may be selected as the structure of the pixel.

In the present disclosure, the OLED may generate light having various suitable colors including red, green, and blue in response to current supplied from the drive transistor, but the present disclosure is not limited thereto. For instance, the OLED may generate white light depending on the amount of current supplied from the drive transistor. In this case, a separate color filter or the like may be used to embody a color image.

Referring to FIG. 4B, first, a light-emitting control signal F1*i* is supplied to the i-th first-light-emitting control line E1*i*. When the light-emitting control signal F1*i* is supplied to the i-th first-light-emitting control line E1*i*, the fifth transistor T5 and the sixth transistor T6 are turned off. Here, the first pixel PXL1 may be set to a non-light-emitting state.

Subsequently, a scan signal G1*i*−1 is supplied to the i−1-th first scan line S1*i*−1, so that the fourth transistor T4 is turned on. When the fourth transistor T4 is turned on, the voltage of the initialization power supply Vint is supplied to the first node N1. Then, the first node N1 may be initialized to the voltage of the initialization power supply Vint.

After the first node N1 has been initialized to the voltage of the initialization power supply Vint, a scan signal G1*i* is supplied to the i-th first-scan line S1*i*. When the scan signal G1*i* is supplied to the i-th first-scan line S1*i*, the second transistor T2 and the third transistor T3 are turned on.

When the third transistor T3 is turned on, the first transistor T1 is connected in the form of a diode.

When the second transistor T2 is turned on, a data signal is supplied from the m-th data line Dm to the first electrode of the first transistor T1. Here, because the first node N1 has been initialized to the voltage of the initialization power supply Vint that is lower than the data signal, the first transistor T1 may be turned on. When the first transistor T1 is turned on, a voltage formed by subtracting the threshold voltage of the first transistor T1 from the data signal is applied to the first node N1. The storage capacitor Cst stores a voltage corresponding to the data signal to the first node N1 and the threshold voltage of the first transistor T1.

Thereafter, a scan signal G1*i*+1 is supplied to the i+1-th first-scan line S1*i*+1. When the scan signal G1*i*+1 is supplied to the i+1-th first-scan line S1*i*+1, the seventh transistor T7 is turned on.

When the seventh transistor T7 is turned on, the voltage of the initialization power supply Vint is supplied to the anode electrode of the OLED. Then, a parasitic capacitor that is parasitically formed in the OLED is discharged. As a result, the black expression performance may be enhanced.

Thereafter, the supply of the light-emitting control signal F1*i* to the i-th first-light-emitting control line E1*i* is interrupted (e.g., ceased).

When the supply of the light-emitting control signal F1*i* to the i-th first-light-emitting control line E1*i* is interrupted, the fifth transistor T5 and the sixth transistor T6 are turned on. Then, there is formed a current path from the first power supply ELVDD to the second power supply ELVSS via the fifth transistor T5, the first transistor T1, the sixth transistor T6, and the OLED.

Here, the first transistor T1 may control, in correspondence with the voltage of the first node N1, current flowing from the first power supply ELVDD to the second power supply ELVSS via the OLED. The OLED may emit light having a luminance (e.g., a predetermined luminance) corresponding to current supplied from the first transistor T1.

Substantially, the first pixel PXL1 may repeatedly perform the above-mentioned process and thus generate light having a set or predetermined luminance. Each of the second pixel PXL2 and the third pixel PXL3 may also be driven in the same or substantially the same manner as the first pixel PXL1.

The light-emitting control signal F1*i* to be supplied to the i-th first-light-emitting control line E1*i* may be supplied to overlap at least one scan signal so that the pixels PXL1, PXL2, and PXL3 are set to a non-light-emitting state during a period in which the data signal is charged to the pixels PXL1, PXL2, and PXL3. Such a supply timing of the light-emitting control signal F1*i* may be variously changed in a suitable manner.

Figure 5A:
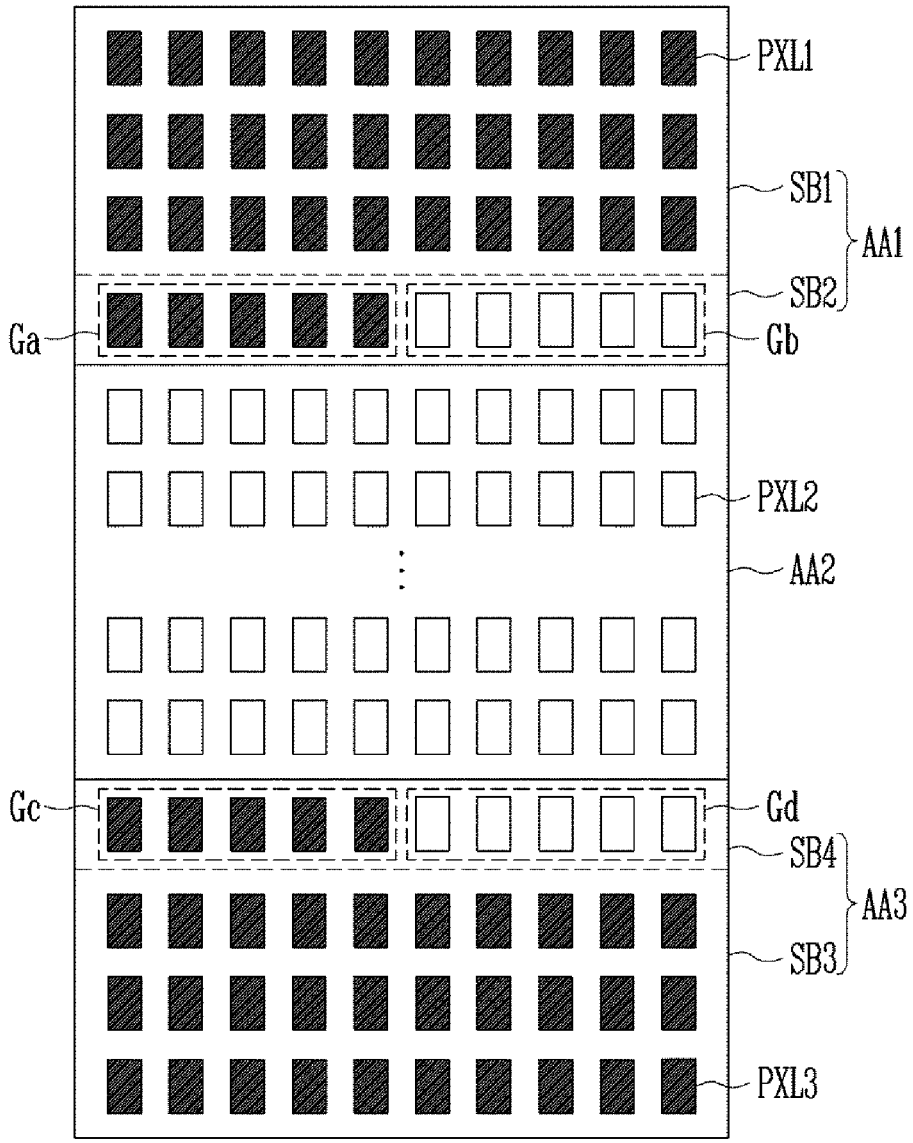
FIGS. 5A-5B are diagrams illustrating an image display operation in a first mode in accordance with an embodiment of the present disclosure.
Figure 5B:
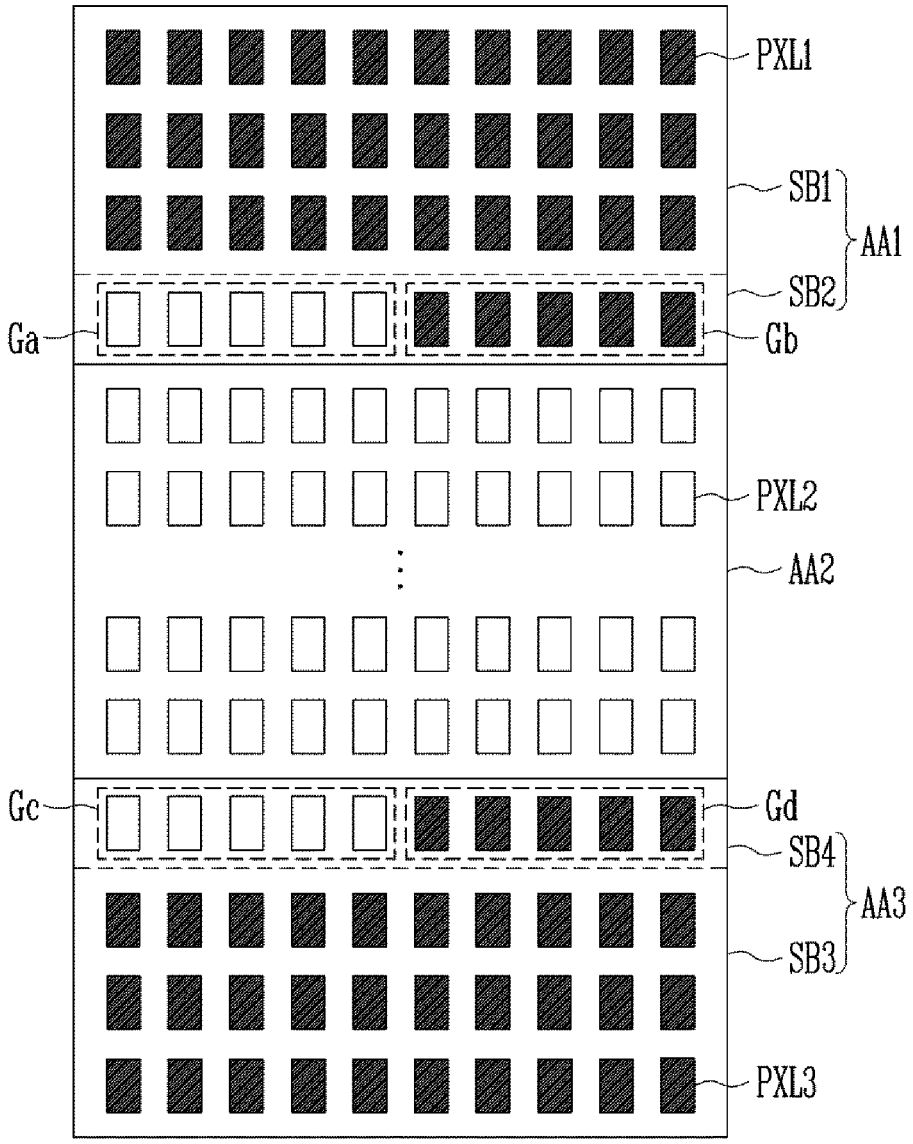

FIGS. 5A and 5B are diagrams illustrating an image display operation in a first mode in accordance with an embodiment of the present disclosure. Particularly, FIG. 5A illustrates an image display operation during a first period in the first mode, and FIG. 5B illustrates an image display operation during a second period in the first mode.

Referring to FIGS. 5A and 5B, the second sub-pixel area SB2 may include first and second pixel groups Ga and Gb, each of which include first pixels PXL1.

Here, the numbers of first pixels PXL1 included in the respective pixel groups Ga and Gb may be set to the same value or different values.

The first pixel group Ga and the second pixel group Gb may display a dummy image having a set or predetermined pattern in the first mode. For example, the first pixel group Ga and the second pixel group Gb may alternately emit light in the first mode.

Referring to FIG. 5A, during the first period, the first pixel group Ga may not emit light, and the second pixel group Gb may emit light.

Referring to FIG. 5B, during the second period different from the first period, the first pixel group Ga may emit light, and the second pixel group Gb may not emit light.

In other words, the first period and the second period may be repeatedly generated, whereby the first pixel group Ga and the second pixel group Gb may alternately emit light in the first mode.

Consequently, a dummy image displayed on the second sub-pixel area SB2 in the first mode may have a pattern in which the pixel groups Ga and Gb alternately emit light.

The fourth sub-pixel area SB4 may be operated in the same or substantially the same manner as the second sub-pixel area SB2.

For this operation, the fourth sub-pixel area SB4 may include first and second pixel groups Gc and Gd, each of which includes third pixels PXL3.

Here, the numbers of third pixels PXL3 included in the respective pixel groups Gc and Gd may be set to the same value or different values.

The first pixel group Gc and the second pixel group Gd may display a dummy image having a set or predetermined pattern in the first mode. For example, the first pixel group Gc and the second pixel group Gd may alternately emit light in the first mode.

Referring to FIG. 5A, during the first period, the first pixel group Gc may not emit light, and the second pixel group Gd may emit light.

Referring to FIG. 5B, during the second period different from the first period, the first pixel group Gc may emit light, and the second pixel group Gd may not emit light.

In other words, the first period and the second period may be repeatedly generated, whereby the first pixel group Gc and the second pixel group Gd may alternately emit light in the first mode.

Consequently, a dummy image displayed on the fourth sub-pixel area SB4 in the first mode may have a pattern in which the pixel groups Gc and Gd alternately emit light.

Both the first sub-pixel area SB1 and the third sub-pixel area SB3 may display a black image in the first mode. In other words, the first pixels PXL1 included in the first sub-pixel area SB1 and the third pixels PXL3 included in the third sub-pixel area SB3 may be maintained in a non-light-emitting state during the first and second periods.

The second pixel area AA2 may display a valid image in the first mode. The second pixels PXL2 included in the second pixel area AA2 may perform a normal light-emitting operation during the first and second periods.

In FIGS. 5A and 5B, there is illustrated an example in which each of the second and fourth sub-pixel areas SB2 and SB4 includes one pixel row, but the present disclosure is not limited thereto. Each of the second and fourth sub-pixel areas SB2 and SB4 may include a plurality of pixel rows.

The shape and number of pixel groups Ga, Gb, Gc, and Gd may be changed in various suitable ways.

Figure 6A:
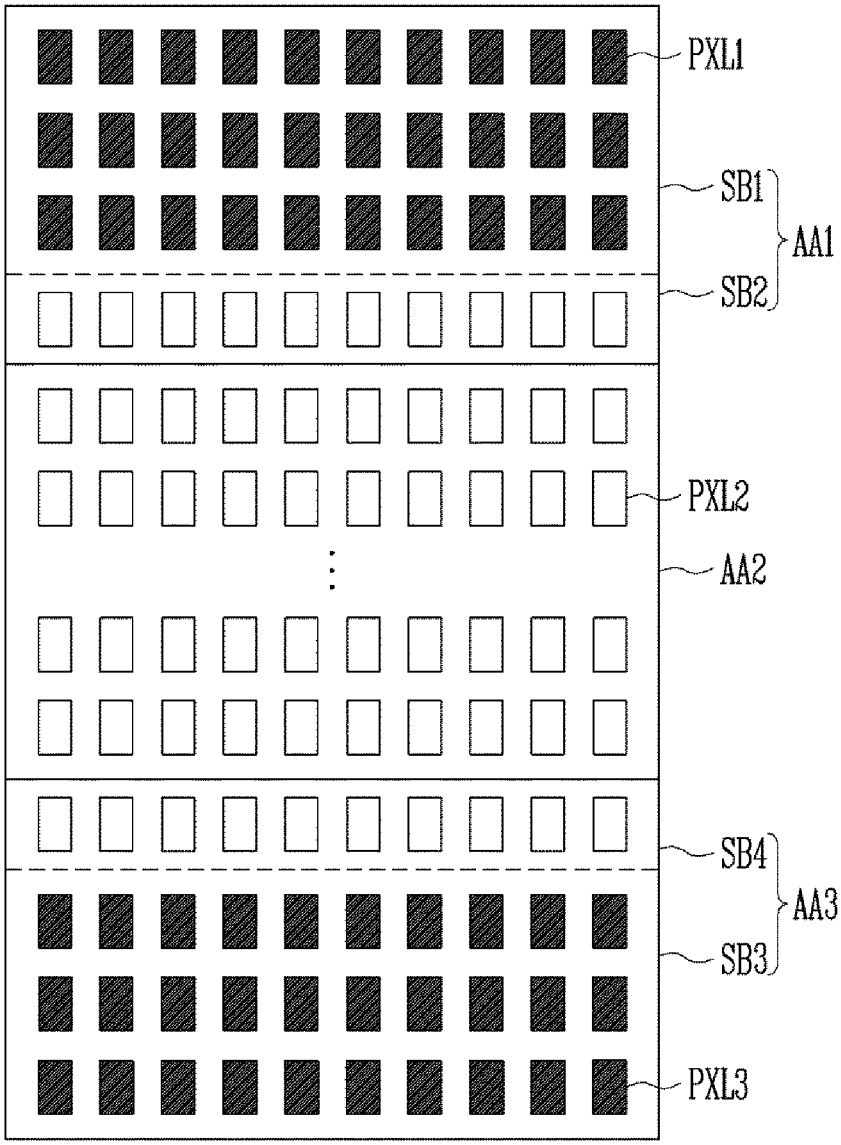
FIGS. 6A-6B are diagrams illustrating an image display operation in a first mode in accordance with an embodiment of the present disclosure.
Figure 6B:
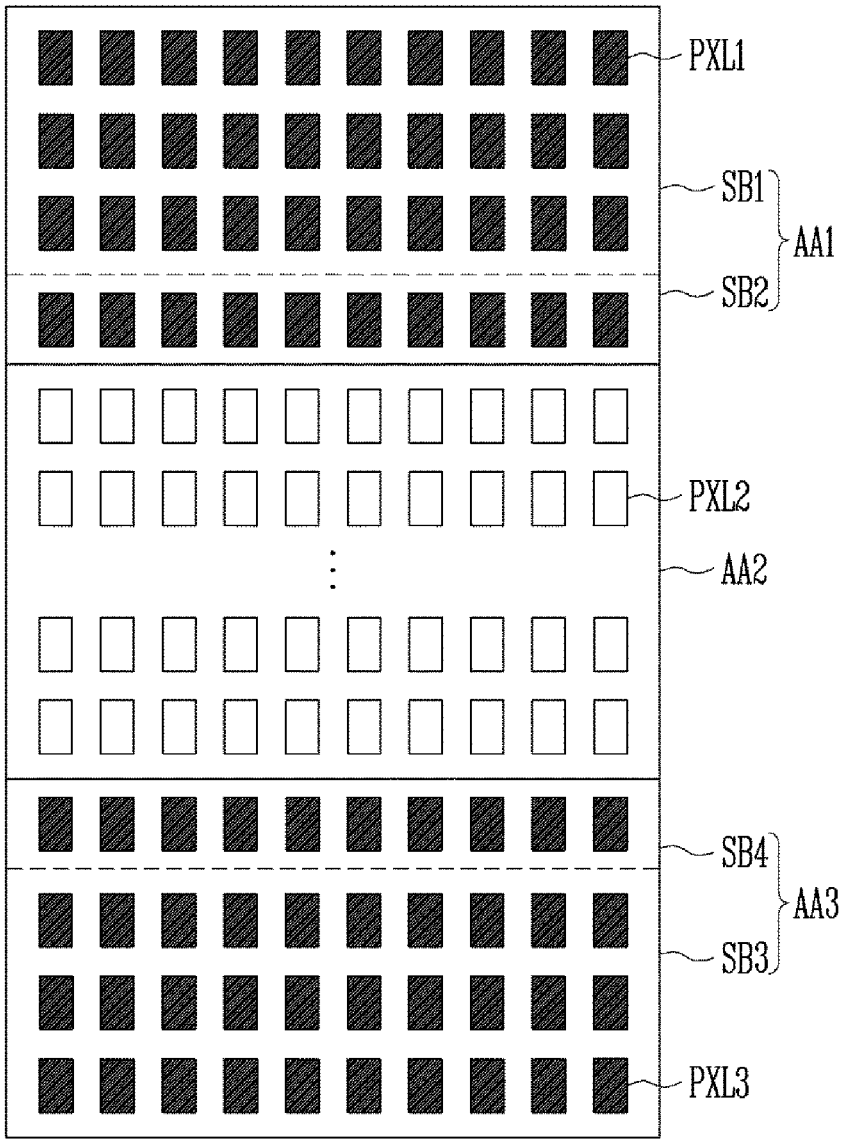

FIGS. 6A and 6B are diagrams illustrating an image display operation in a first mode in accordance with another embodiment of the present disclosure. Particularly, FIG. 6A illustrates an image display operation during a first period in the first mode, and FIG. 6B illustrates an image display operation during a second period in the first mode.

Referring to FIGS. 6A and 6B, the second sub-pixel area SB2 may include at least one pixel row including first pixels PXL1.

The second sub-pixel area SB2 may display a dummy image having a set or predetermined pattern in the first mode.

For example, the second sub-pixel area SB2 may repeat a light-emitting operation and a non-light-emitting operation on at least one horizontal line basis in the first mode.

Referring to FIG. 6A, at least one pixel row disposed in the second sub-pixel area SB2 may emit light during the first period.

Referring to FIG. 6B, the at least one pixel row disposed in the second sub-pixel area SB2 may not emit light during the second period.

In other words, the first period and the second period may be repeatedly generated, whereby the pixel row included in the second sub-pixel area SB2 may repeat a light-emitting operation and a non-light-emitting operation in the first mode.

Consequently, a dummy image displayed on the second sub-pixel area SB2 in the first mode may have a pattern in which at least one pixel row repeat a light-emitting operation and a non-light-emitting operation.

The fourth sub-pixel area SB4 may be operated in the same or substantially the same manner as the second sub-pixel area SB2.

The fourth sub-pixel area SB4 may include at least one pixel row including third pixels PXL3.

The fourth sub-pixel area SB4 may display a dummy image having a set or predetermined pattern in the first mode.

For example, the fourth sub-pixel area SB4 may repeat a light-emitting operation and a non-light-emitting operation on at least one horizontal line basis in the first mode.

Referring to FIG. 6A, at least one pixel row disposed in the fourth sub-pixel area SB4 may emit light during the first period.

Referring to FIG. 6B, the at least one pixel row disposed in the fourth sub-pixel area SB4 may not emit light during the second period.

In other words, the first period and the second period may be repeatedly generated, whereby the pixel row included in the fourth sub-pixel area SB4 may repeat a light-emitting operation and a non-light-emitting operation in the first mode.

Consequently, a dummy image displayed on the fourth sub-pixel area SB4 in the first mode may have a pattern in which at least one pixel row repeat a light-emitting operation and a non-light-emitting operation.

Both the first sub-pixel area SB1 and the third sub-pixel area SB3 may display a black image in the first mode. In other words, the first pixels PXL1 included in the first sub-pixel area SB1 and the third pixels PXL3 included in the third sub-pixel area SB3 may be maintained in a non-light-emitting state during the first and second periods.

The second pixel area AA2 may display a valid image in the first mode. The second pixels PXL2 included in the second pixel area AA2 may perform a normal light-emitting operation during the first and second periods.

In FIGS. 6A and 6B, there is illustrated an example in which each of the second and fourth sub-pixel areas SB2 and SB4 includes one pixel row, but the present disclosure is not limited thereto. Each of the second and fourth sub-pixel areas SB2 and SB4 may include a plurality of pixel rows.

Figure 7A:
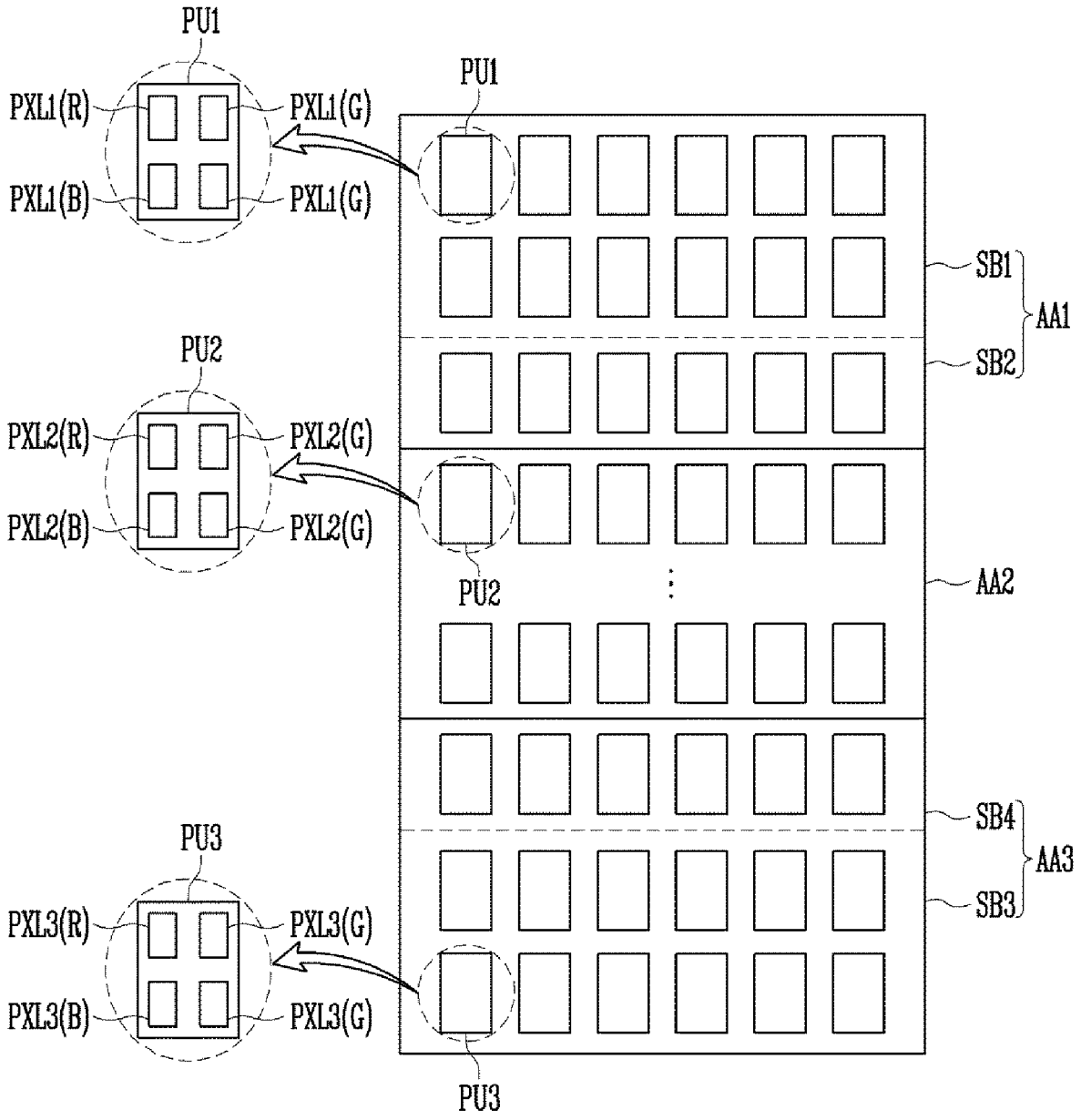
FIG. 7A is a diagram illustrating pixel units in accordance with an embodiment of the present disclosure.
Figure 7B:
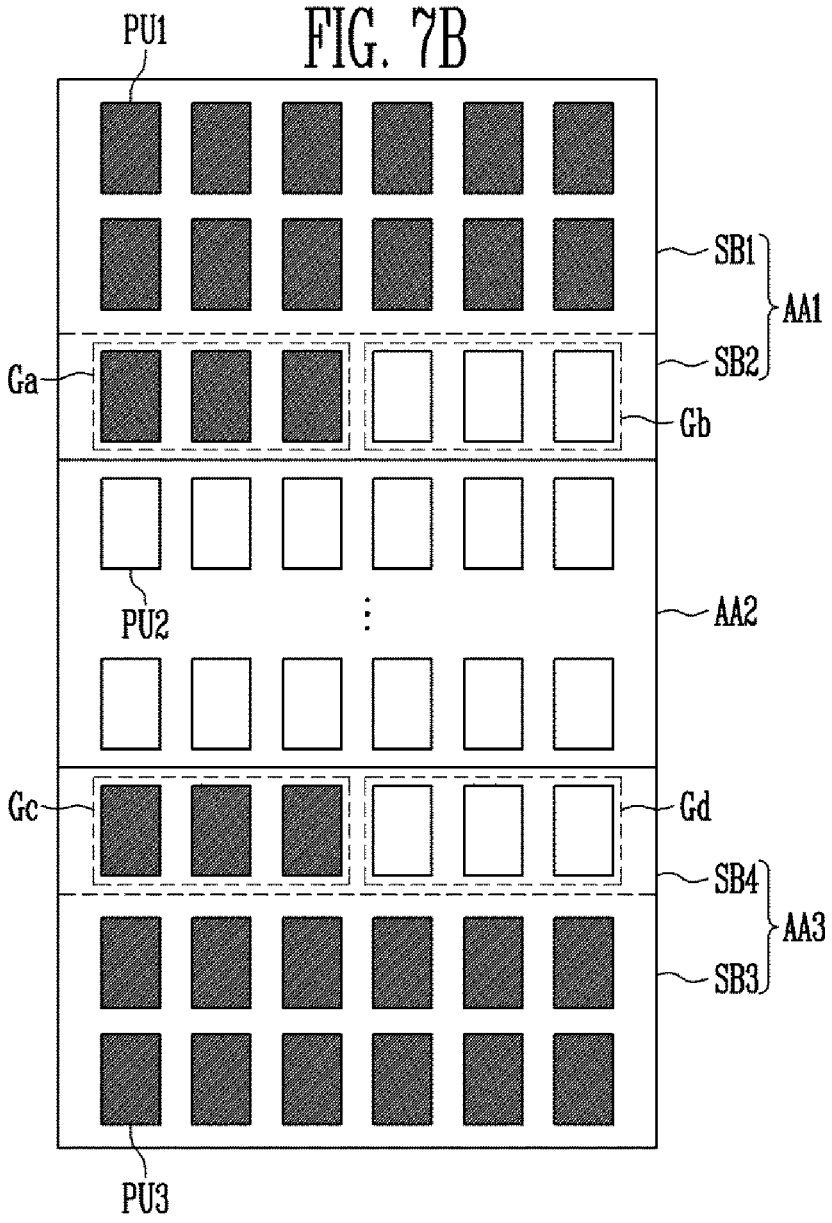
FIGS. 7B-7C are diagrams illustrating an image display operation in a first mode in accordance with an embodiment of the present disclosure.
Figure 7C:
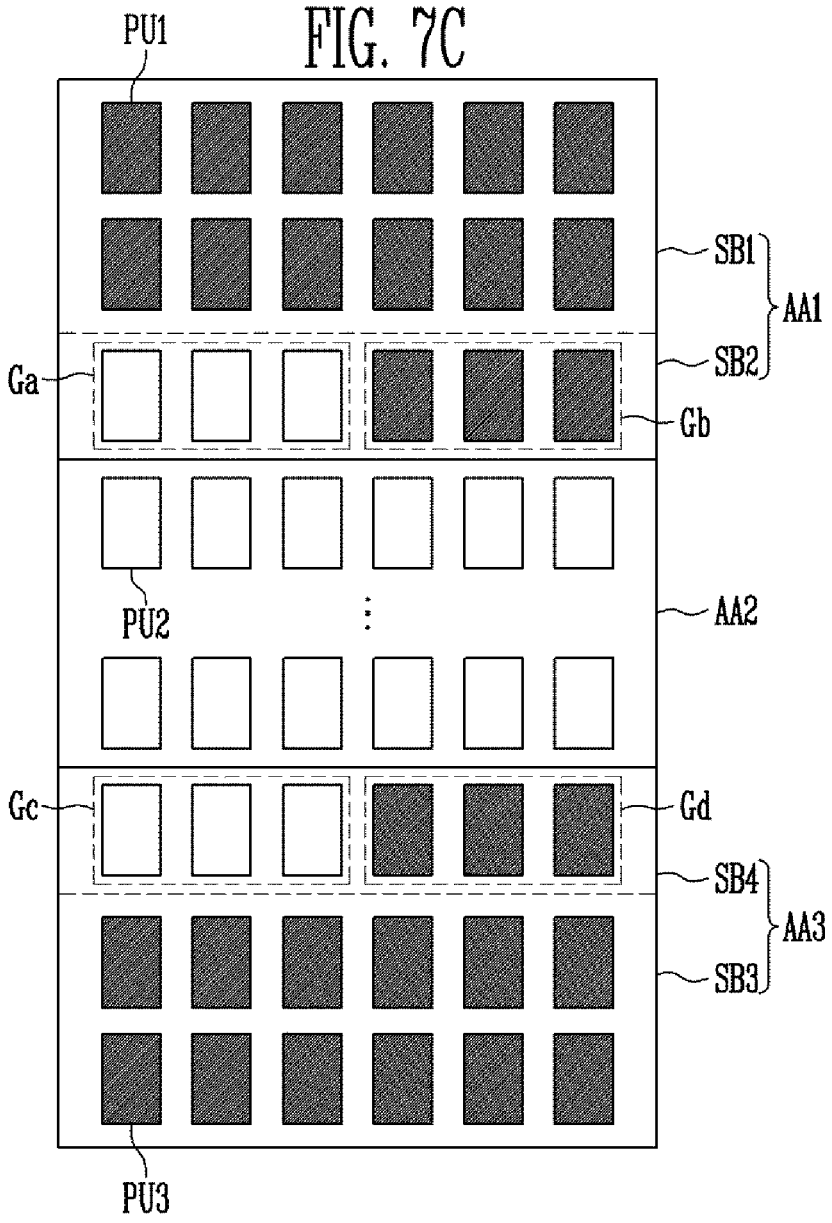
Figure 7D:
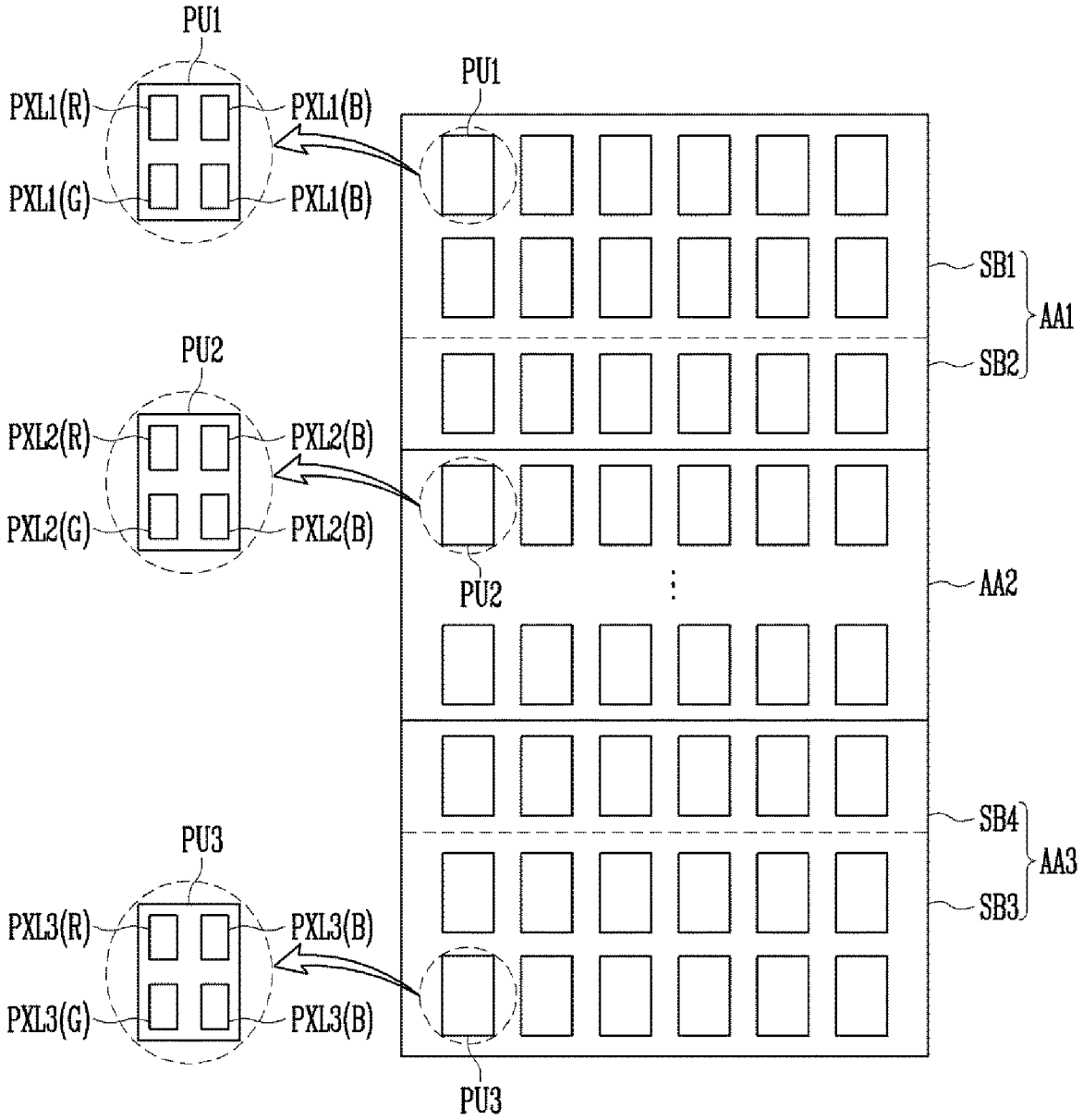
FIG. 7D is a diagram illustrating pixel units in accordance with an embodiment of the present disclosure.

FIG. 7A is a diagram illustrating pixel units in accordance with an embodiment of the present disclosure. FIGS. 7B and 7C are diagrams illustrating an image display operation in the first mode in accordance with an embodiment of the present disclosure. FIG. 7D is a diagram illustrating pixel units in accordance with an embodiment of the present disclosure. Particularly, FIG. 7B illustrates an image display operation during the first period in the first mode, and FIG. 7C illustrates an image display operation during the second period in the first mode.

Referring to FIG. 7A, pixel units PU1, PU2, and PU3 may be disposed in pixel areas AA1, AA2, and AA3. For example, first pixel units PU1 may be disposed in the first pixel area AA1. Second pixel units PU2 may be disposed in the second pixel area AA2. Third pixel units PU3 may be disposed in the third pixel area AA3.

Each of the pixel units PU1, PU2, and PU3 may include a plurality of pixels PXL1, PXL2, or PXL3.

For instance, each of the first pixel units PU1 may be formed of a plurality of first pixels PXL1. Each of the second pixel units PU2 may be formed of a plurality of second pixels PXL2. Each of the third pixel units PU3 may be formed of a plurality of third pixels PXL3.

In an embodiment, each first pixel unit PU1 may include four first pixels PXL1. The four first pixels PXL1 may include one first pixel PXL1(R), which emits red light, one first pixel PXL1(B), which emits blue light, and two first pixels PXL1(G), which emit green light.

Each second pixel unit PU2 may include four second pixels PXL2. The four second pixels PXL2 may include one second pixel PXL2(R), which emits red light, one second pixel PXL2(B), which emits blue light, and two second pixels PXL2(G), which emit green light.

Each third pixel unit PU3 may include four third pixels PXL3. The four third pixels PXL3 may include one third pixel PXL3(R), which emits red light, one third pixel PXL3(B), which emits blue light, and two third pixels PXL3(G), which emit green light.

Referring to FIGS. 7B and 7C, the second sub-pixel area SB2 may include first and second pixel groups Ga and Gb, each of which include first pixel units PU1.

Here, the numbers of first pixel units PU1 included in the respective pixel groups Ga and Gb may be set to the same value or different values.

The first pixel group Ga and the second pixel group Gb may display a dummy image having a certain pattern in the first mode. For example, the first pixel group Ga and the second pixel group Gb may alternately emit light in the first mode.

Referring to FIG. 7B, during the first period, the first pixel group Ga may not emit light, and the second pixel group Gb may emit light.

Referring to FIG. 7C, during the second period different from the first period, the first pixel group Ga may emit light, and the second pixel group Gb may not emit light.

In other words, the first period and the second period may be repeatedly generated, whereby the first pixel group Ga and the second pixel group Gb may alternately emit light in the first mode.

Consequently, a dummy image displayed on the second sub-pixel area SB2 in the first mode may have a pattern in which the pixel groups Ga and Gb alternately emit light.

The fourth sub-pixel area SB4 may be operated in the same or substantially the same manner as the second sub-pixel area SB2.

For this operation, the fourth sub-pixel area SB4 may include first and second pixel groups Gc and Gd, each of which includes third pixel units PU3.

Here, the numbers of third pixel units PU3 included in the respective pixel groups Gc and Gd may be set to the same value or different values.

The first pixel group Gc and the second pixel group Gd may display a dummy image having a certain pattern in the first mode. For example, the first pixel group Gc and the second pixel group Gd may alternately emit light in the first mode.

Referring to FIG. 7D, during the first period, the first pixel group Gc may not emit light, and the second pixel group Gd may emit light.

Referring to FIG. 7C, during the second period different from the first period, the first pixel group Gc may emit light, and the second pixel group Gd may not emit light.

In other words, the first period and the second period may be repeatedly generated, whereby the first pixel group Gc and the second pixel group Gd may alternately emit light in the first mode.

Consequently, a dummy image displayed on the fourth sub-pixel area SB4 in the first mode may have a pattern in which the pixel groups Gc and Gd alternately emit light.

Both the first sub-pixel area SB1 and the third sub-pixel area SB3 may display a black image in the first mode. In other words, the first pixel units PU1 included in the first sub-pixel area SB1 and the third pixel units PU3 included in the third sub-pixel area SB3 may be maintained in a non-light-emitting state during the first and second periods.

The second pixel area AA2 may display a valid image in the first mode. The second pixel units PU2 included in the second pixel area AA2 may perform a normal light-emitting operation during the first and second periods.

Referring to FIG. 7D, each of the pixel units PU1, PU2, and PU3 may be formed of a combination of pixels PXL1, PXL2, and PXL3 different from that of FIG. 7A.

For example, each first pixel unit PU1 may include four first pixels PXL1. The four first pixels PXL1 may include one first pixel PXL1(R), which emits red light, one first pixel PXL1(G), which emits green light, and two first pixels PXL1(B), which emit blue light.

Each second pixel unit PU2 may include four second pixels PXL2. The four second pixels PXL2 may include one second pixel PXL2(R), which emits red light, one second pixel PXL2(G), which emits green light, and two second pixels PXL2(B), which emit blue light.

Each third pixel unit PU3 may include four third pixels PXL3. The four third pixels PXL3 may include one third pixel PXL3(R), which emits red light, one third pixel PXL3(G), which emits green light, and two third pixels PXL3(B), which emit blue light.

FIGS. 8A to 8E are diagrams illustrating an image display operation in a first mode in accordance with an embodiment of the present disclosure. Particularly, FIGS. 8A to 8E respectively illustrate image display operations in a first mode during first to fifth periods.

Figure 8A:
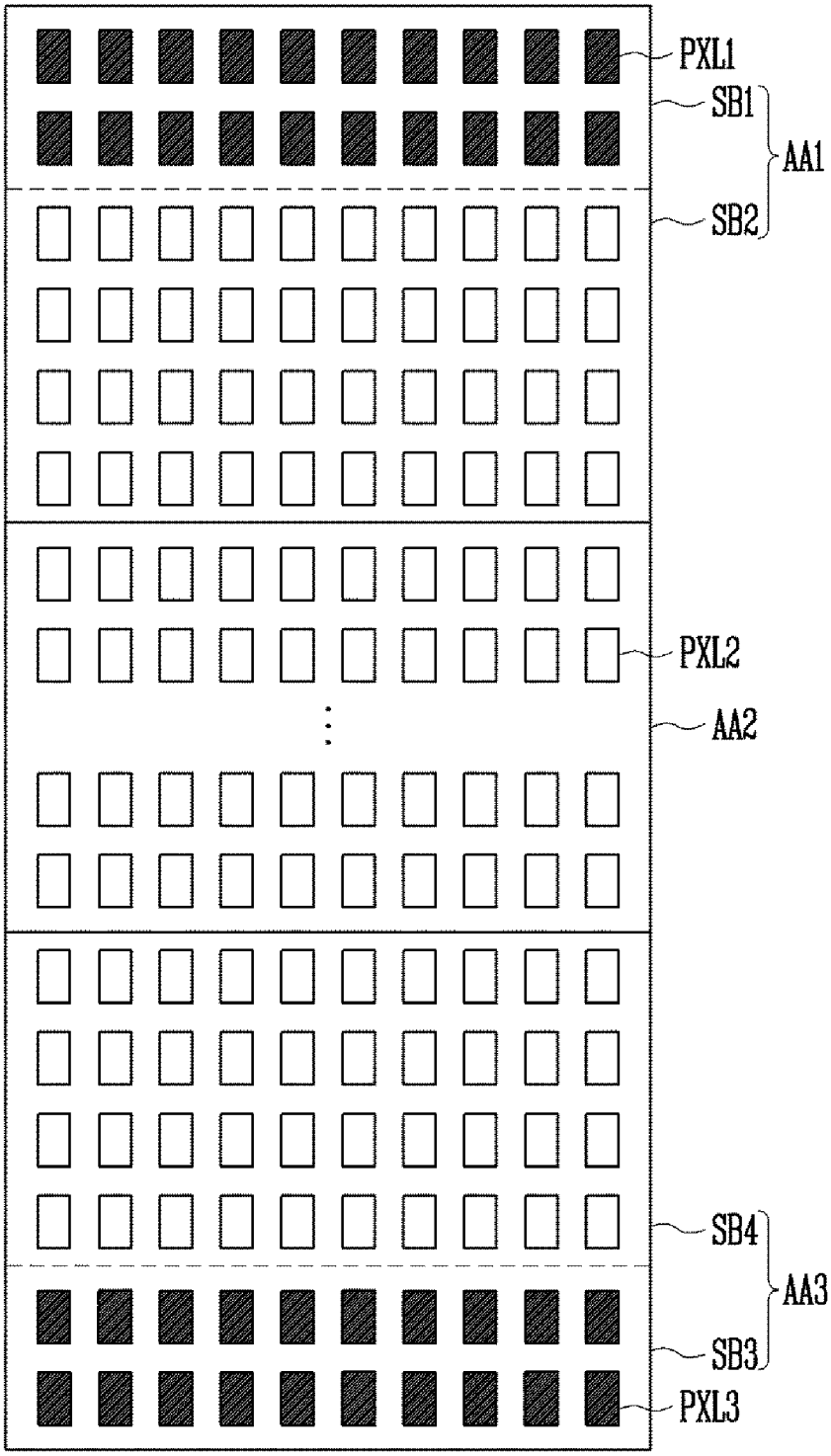
FIGS. 8A-8E are diagrams illustrating an image display operation in a first mode in accordance with an embodiment of the present disclosure.
Figure 8B:
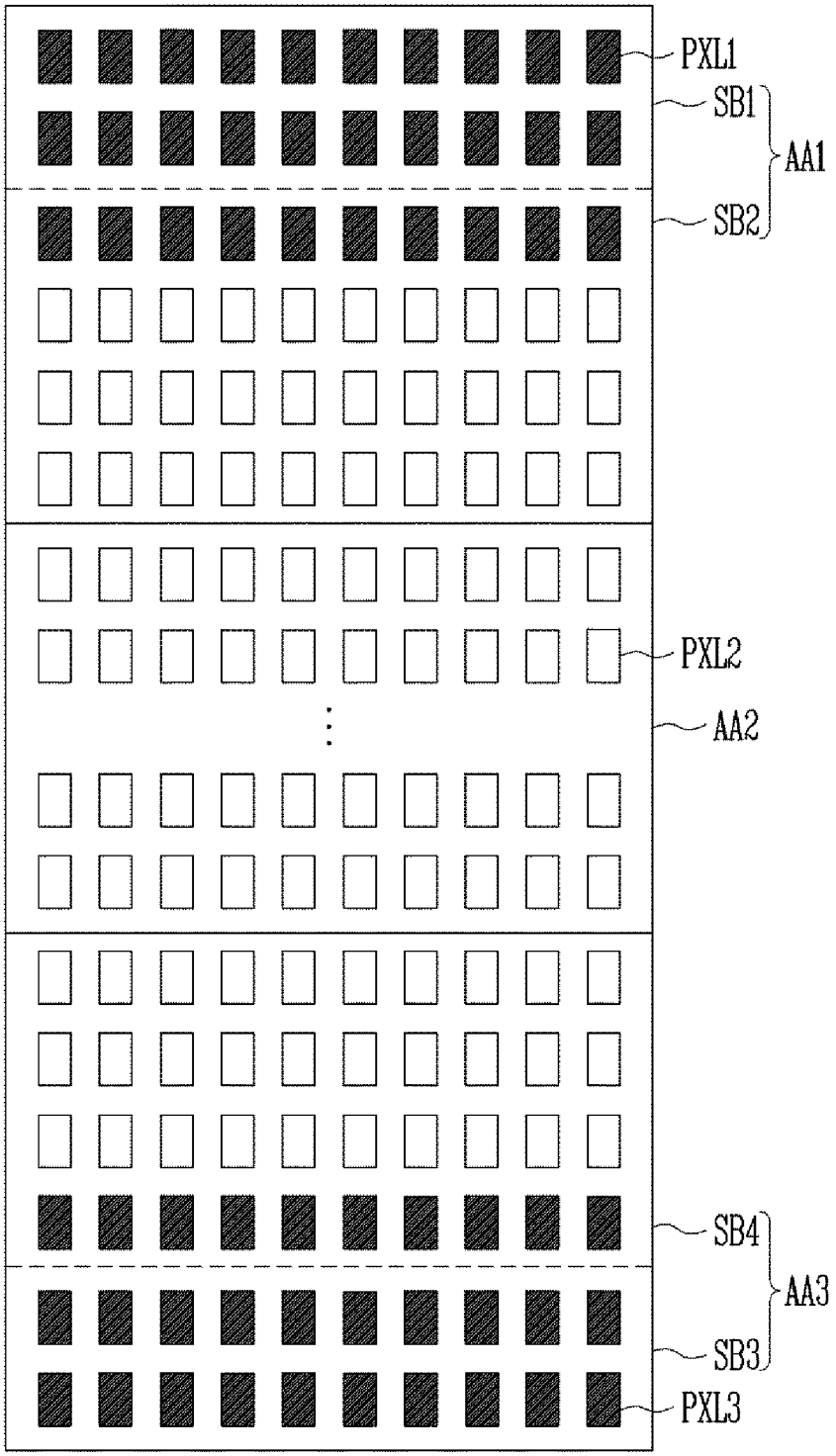
Figure 8C:
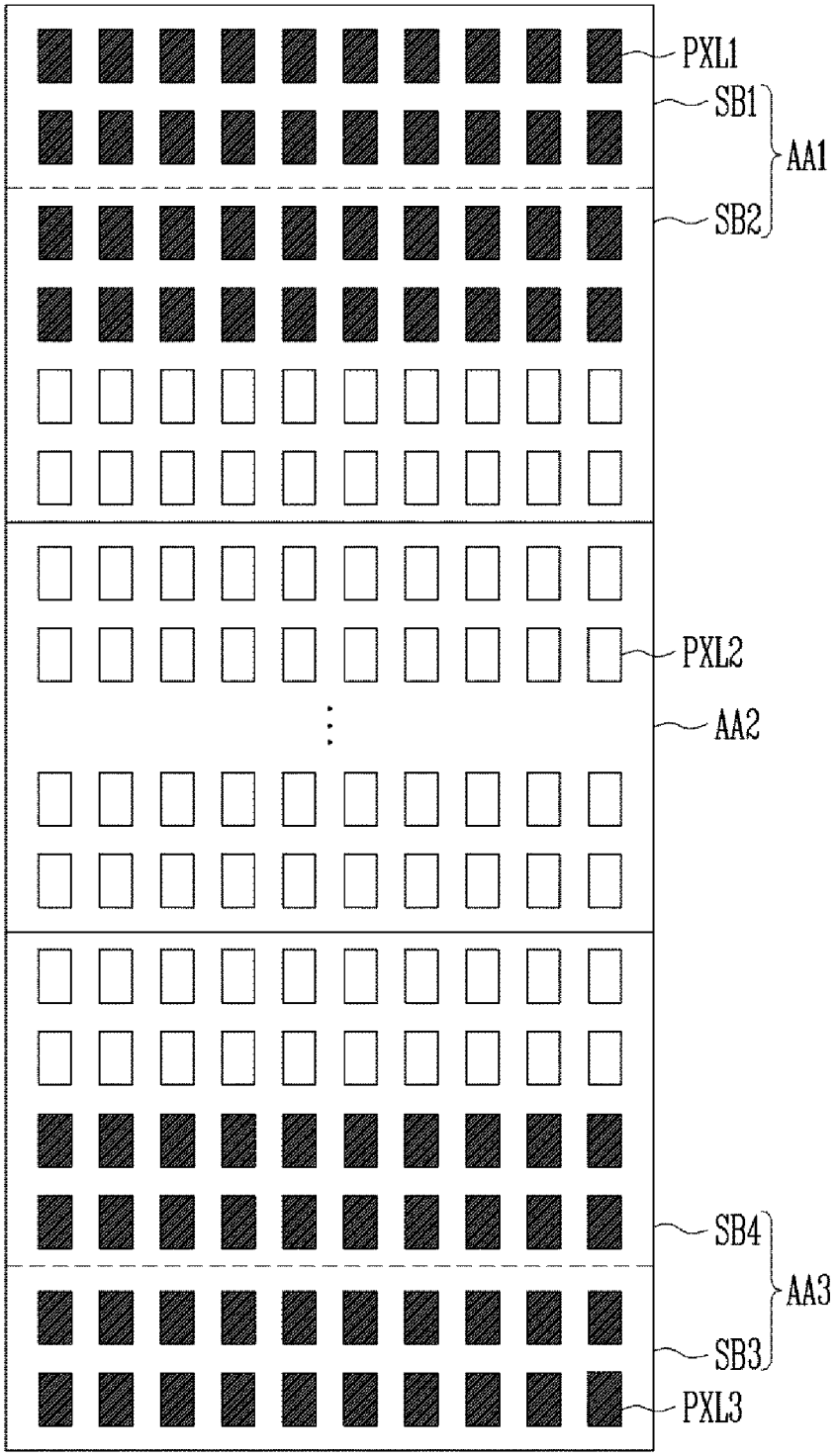
Figure 8D:
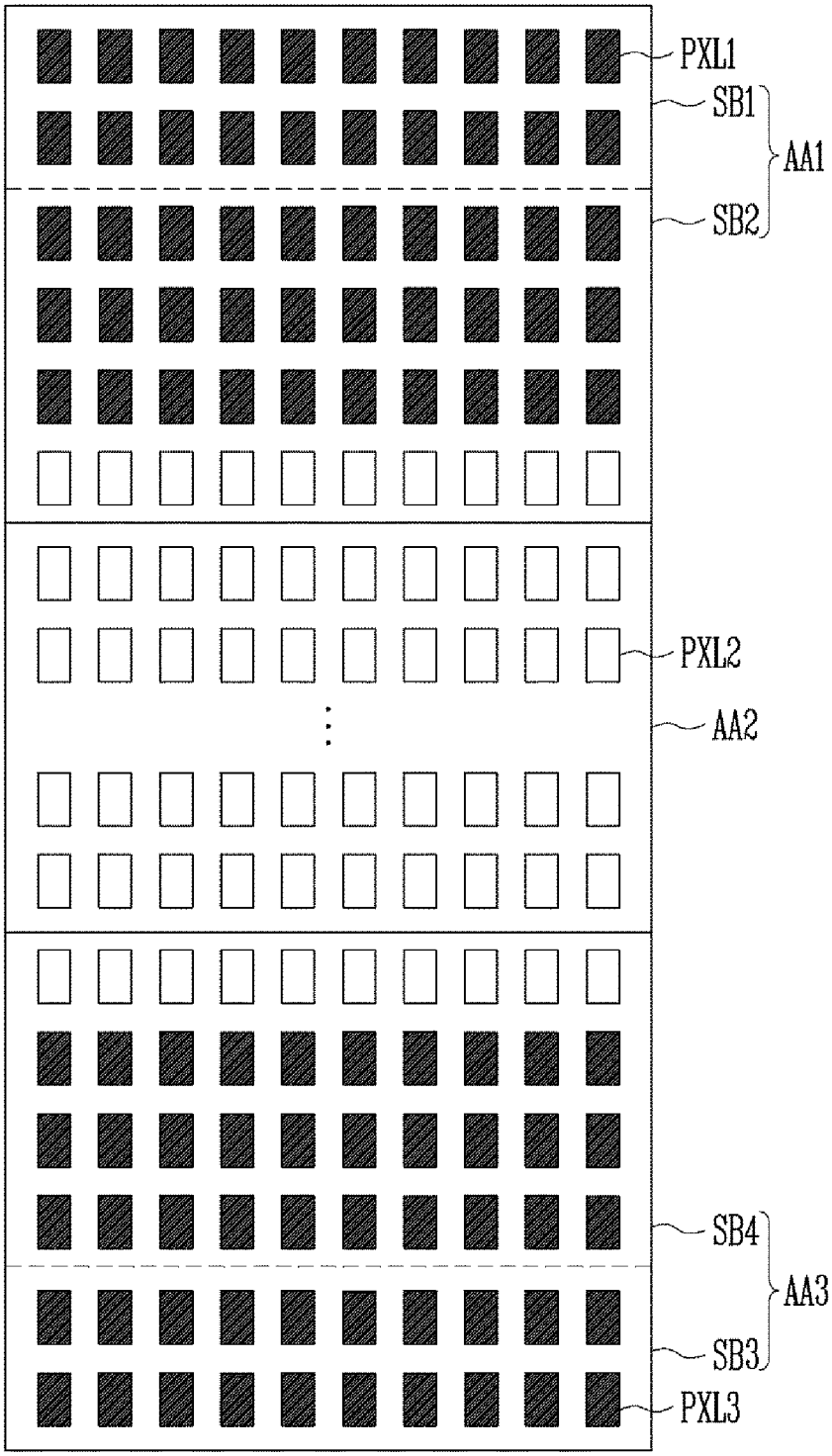
Figure 8E:
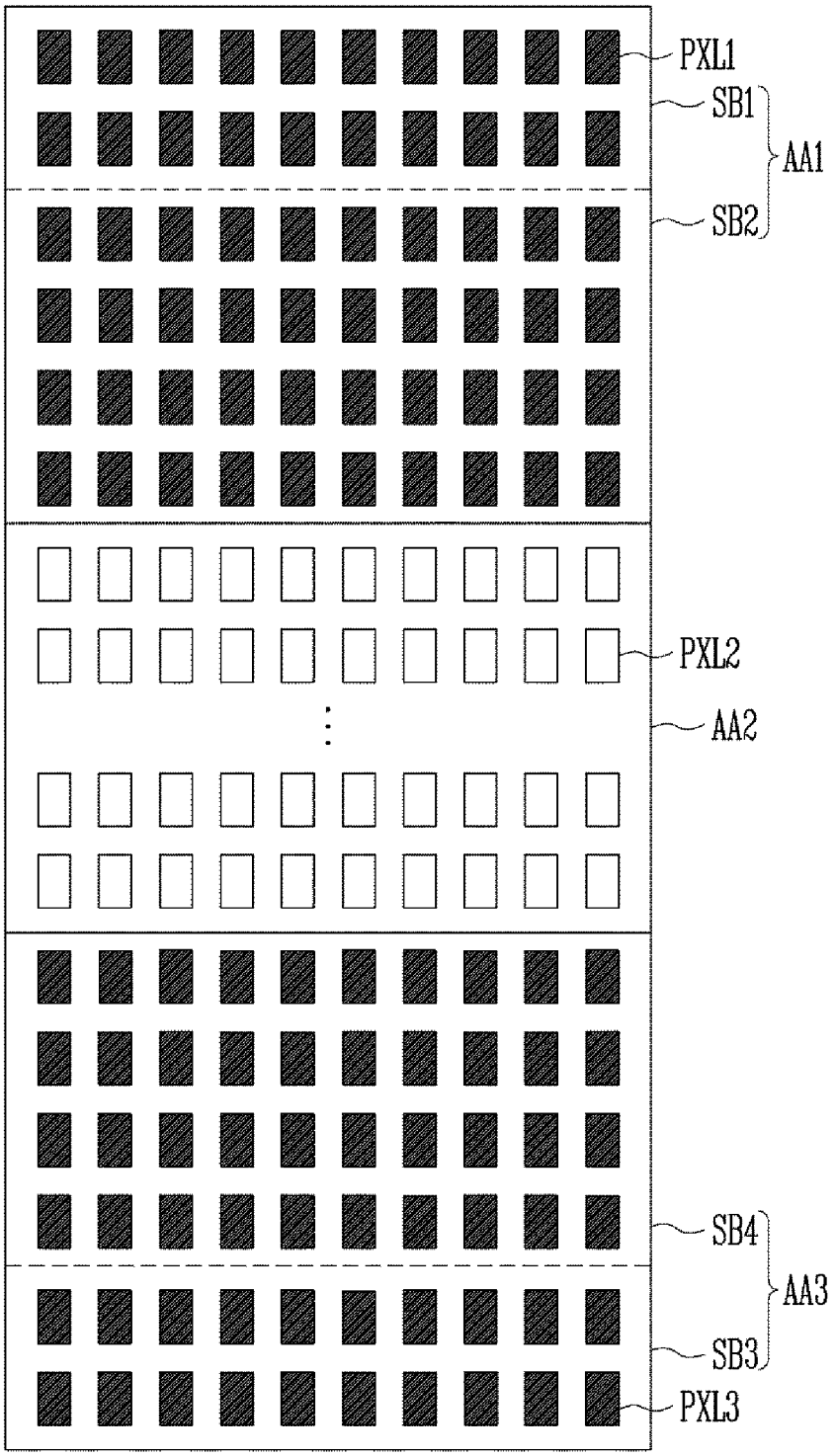

Referring to FIGS. 8A and 8E, the second sub-pixel area SB2 may include a plurality of pixel rows including first pixels PXL1.

The second sub-pixel area SB2 may display a dummy image having a set or predetermined pattern in the first mode.

For example, the second sub-pixel area SB2 may emit light overall in the first mode and then may not sequentially emit light on at least one horizontal line basis.

For this operation, the first pixels PXL1 included in the second sub-pixel area SB2 may emit light overall and then may not sequentially emit light on at least one pixel row basis.

Referring to FIG. 8A, all of the pixel rows disposed in the second sub-pixel area SB2 may emit light overall during the first period.

Referring to FIGS. 8B to 8E, the pixel rows disposed in the second sub-pixel area SB2 may not sequentially emit light from the second period to the fifth period.

During the fifth period, all of the pixel rows disposed in the second sub-pixel area SB2 may not emit light overall.

Here, the first pixels PXL1 of the second sub-pixel area SB2 may not emit light in a sequence from a pixel row disposed farthest from the second pixel area AA2 to a pixel row disposed closest to the second pixel area AA2.

The first to fifth periods may be repeatedly generated in the first mode. Thus, the second sub-pixel area SB2 may display a dummy image having a certain pattern.

The fourth sub-pixel area SB4 may be operated in the same or substantially the same manner as the second sub-pixel area SB2.

For this operation, the fourth sub-pixel area SB4 may include a plurality of pixel rows including third pixels PXL3.

The fourth sub-pixel area SB4 may display a dummy image having a set or predetermined pattern during the first mode.

For example, the fourth sub-pixel area SB4 may emit light overall in the first mode and then may not sequentially emit light on at least one horizontal line basis.

For this operation, the third pixels PXL3 included in the fourth sub-pixel area SB4 may all emit light and then sequentially not emit light on at least one pixel row basis.

Referring to FIG. 8A, all of the pixel rows disposed in the second sub-pixel area SB2 may emit light overall during the first period.

Referring to FIGS. 8B to 8E, the pixel rows disposed in the fourth sub-pixel area SB4 may not sequentially emit light from the second period to the fifth period.

During the fifth period, all of the pixel rows disposed in the fourth sub-pixel area SB4 may not emit light overall.

Here, the third pixels PXL3 of the fourth sub-pixel area SB4 may not emit light in a sequence from a pixel row disposed farthest from the second pixel area AA2 to a pixel row disposed closest to the second pixel area AA2.

The first to fifth periods may be repeatedly generated in the first mode. Thus, the fourth sub-pixel area SB4 may display a dummy image having a certain pattern.

Both the first sub-pixel area SB1 and the third sub-pixel area SB3 may display a black image in the first mode. In other words, the first pixels PXL1 included in the first sub-pixel area SB1 and the third pixels PXL3 included in the third sub-pixel area SB3 may be maintained in a non-light-emitting state during the first to fifth periods.

The second pixel area AA2 may display a valid image in the first mode. The second pixels PXL2 included in the second pixel area AA2 may perform a normal light-emitting operation during the first to fifth periods.

In FIGS. 8A to 8E, there has been illustrated an example in which the pixel rows does not sequentially emit light on a pixel row basis, but the present disclosure is not limited thereto. For example, the pixel rows may not sequentially emit light on a basis of a plurality of pixel rows.

Figure 9:
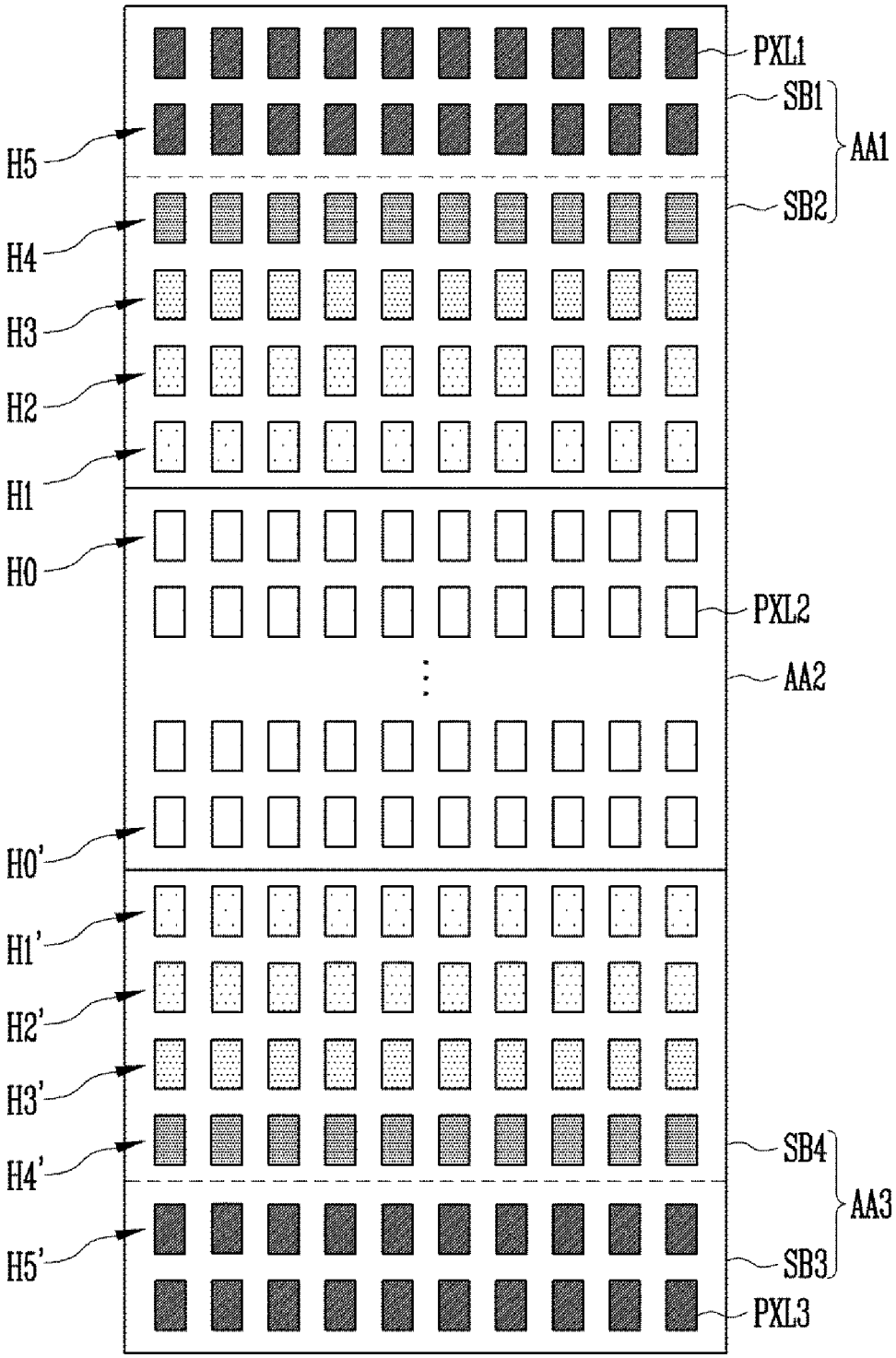
FIG. 9 is a diagram illustrating an image display operation in a first mode in accordance with an embodiment of the present disclosure.

FIG. 9 is a diagram illustrating an image display operation in a first mode in accordance with an embodiment of the present disclosure.

Referring to FIG. 9, first pixels PXL1 disposed in the second sub-pixel area SB2 may display a dummy image having a set or predetermined pattern in the first mode.

For example, the luminance of the dummy image may be reduced gradually (e.g., in stages or discrete levels) in a direction away from the second pixel area AA2.

For this operation, in the first mode, the luminance of the second sub-pixel area SB2 may be reduced in a direction away from the second pixel area AA2 on a horizontal line basis.

For example, first pixels PXL1 disposed on a first horizontal line H1 may emit light at a first luminance. First pixels PXL1 disposed on a second horizontal line H2 may emit light at a second luminance. First pixels PXL1 disposed on a third horizontal line H3 may emit light at a third luminance. First pixels PXL1 disposed on a fourth horizontal line H4 may emit light at a fourth luminance. Here, the first luminance, the second luminance, the third luminance, and the fourth luminance may be successively reduced in value.

In other words, the first pixels PXL1 disposed on the first horizontal line H1 adjacent to the second pixel area AA2 may have the highest luminance, and the first pixels PXL1 disposed on the fourth horizontal line H4 adjacent to the first sub-pixel area SB1 may have the lowest luminance.

The luminance of the first pixels PXL1 disposed on the first horizontal line H1 may be set lower than the luminance of second pixels PXL2 disposed on a horizontal line H0 adjacent to the second sub-pixel area SB2 among the horizontal lines of the second pixel area AA2.

The luminance of the first pixels PXL1 disposed on the fourth horizontal line H4 may be set higher than the luminance of first pixels PXL1 disposed on a horizontal line H5 adjacent to the second sub-pixel area SB2 among the horizontal lines of the first sub-pixel area SB1.

The fourth sub-pixel area SB4 may be operated in the same or substantially the same manner as the second sub-pixel area SB2.

In other words, third pixels PXL3 disposed in the fourth sub-pixel area SB4 may display a dummy image having a set or predetermined pattern in the first mode.

For example, the luminance of the dummy image may be reduced gradually (e.g., in stages or discrete levels) in a direction away from the second pixel area AA2.

For this operation, in the first mode, the luminance of the fourth sub-pixel area SB4 may be reduced in a direction away from the second pixel area AA2 on a horizontal line basis.

For example, third pixels PXL3 disposed on a first horizontal line H1' may emit light at a first luminance. Third pixels PXL3 disposed on a second horizontal line H2' may emit light at a second luminance. Third pixels PXL3 disposed on a third horizontal line H3' may emit light at a third luminance. Third pixels PXL3 disposed on a fourth horizontal line H4 may emit light at a fourth luminance. Here, the first luminance, the second luminance, the third luminance, and the fourth luminance may be successively reduced in value.

In other words, the third pixels PXL3 disposed on the first horizontal line H1' adjacent to the second pixel area AA2 may have the highest luminance, and the third pixels PXL3 disposed on the fourth horizontal line H4' adjacent to the third sub-pixel area SB3 may have the lowest luminance.

The luminance of the third pixels PXL3 disposed on the first horizontal line H1' may be set lower than the luminance of second pixels PXL2 disposed on a horizontal line H0' adjacent to the fourth sub-pixel area SB4 among the horizontal lines of the second pixel area AA2.

The luminance of the third pixels PXL3 disposed on the fourth horizontal line H4' may be set higher than the luminance of third pixels PXL3 disposed on a horizontal line H5' adjacent to the fourth sub-pixel area SB4 among the horizontal lines of the third sub-pixel area SB3.

Both the first sub-pixel area SB1 and the third sub-pixel area SB3 may display a black image in the first mode. In other words, the first pixels PXL1 included in the first sub-pixel area SB1 and the third pixels PXL3 included in the third sub-pixel area SB3 may be maintained in a non-light-emitting state in the first mode.

The second pixel area AA2 may display a valid image in the first mode. The second pixels PXL2 included in the second pixel area AA2 may perform a normal light-emitting operation in the first mode.

Figure 10:
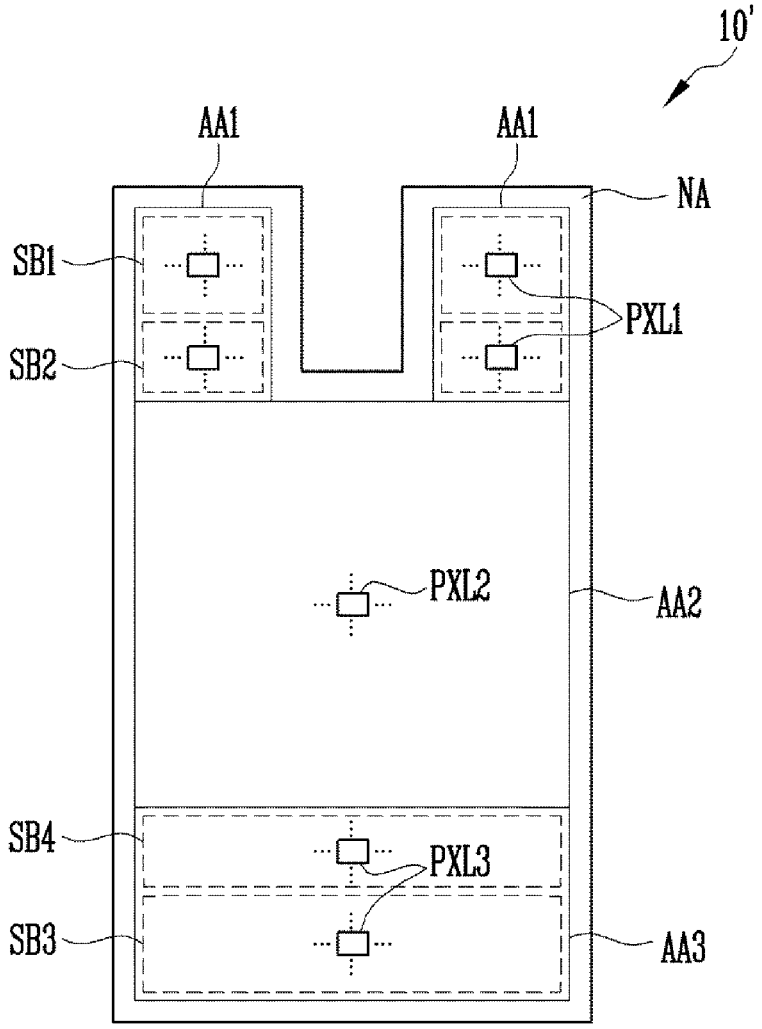
FIG. 10 is a diagram illustrating pixel areas of the display device in accordance with an embodiment of the present disclosure.

FIG. 10 is a diagram illustrating pixel areas of a display device 10' in accordance with an embodiment of the present disclosure. The following description will be focused on differences from the above-stated embodiments, and a description of common aspects may not be repeated.

Referring to FIG. 10, the display device 10' in accordance with the present embodiment may include a plurality of first pixel areas AA1.

The first pixel areas AA1 may be disposed on a first side of a second pixel area AA2.

In this case, the width of each of the first pixel areas AA1 may be set to a value smaller than that of the second pixel area AA2. As described above, each first pixel area AA1 may include a first sub-pixel area SB1, and a second sub-pixel area SB2.

The image display operations of the first and second sub-pixel areas SB1 and SB2 are the same or substantially the same as those of the above-stated embodiments; therefore, detailed description thereof may not be repeated.

A plurality of third pixel areas AA3 may be provided in the same or substantially the same manner as the first pixel areas AA1. In this case, the third pixel areas AA3 may be disposed on a second side of the second pixel area AA2. The width of each of the third pixel areas AA3 may be set to a value smaller than that of the second pixel area AA2.

Figure 11:
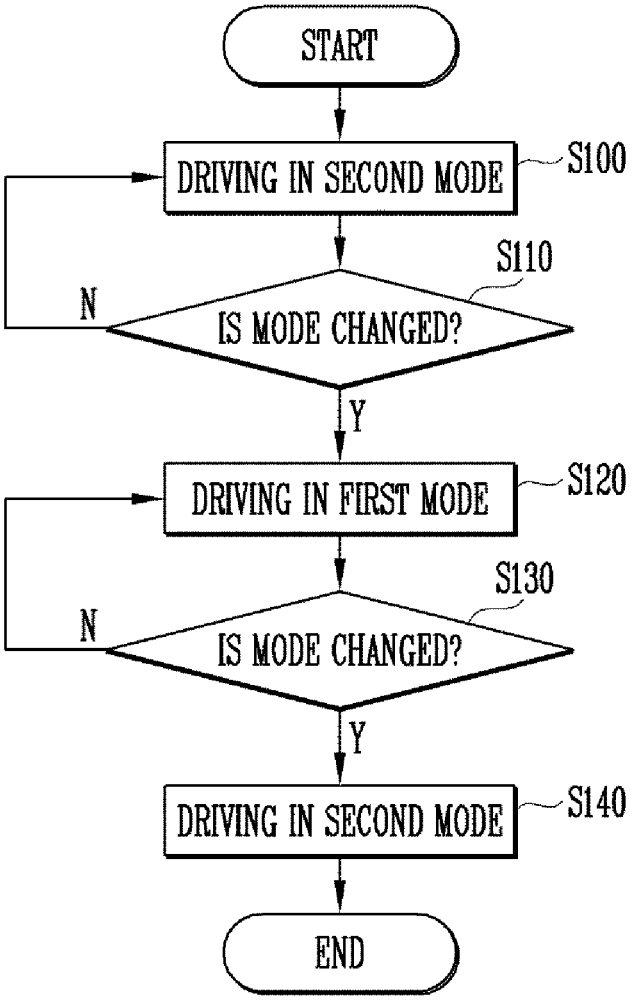
FIG. 11 is a flow diagram showing a method of driving the display device in accordance with an embodiment of the present disclosure.

FIG. 11 is a flow diagram showing a method of driving the display device 10 in accordance with an embodiment of the present disclosure.

Referring to FIG. 11, the display device 10 may be operated in the second mode, at S100. In this case, the display device 10 may display a valid image on the entire display area, that is, including the first pixel area AA1, the second pixel area AA2, and the third pixel area AA3.

While the display device 10 is operated in the second mode, act S110 of determining whether to change the mode may be performed.

At S110, when the display device 10 is mounted to a wearable device 30 or there is a request from the user, the mode of the display device 10 may be changed.

When there is no change in mode, the second mode may be continuously performed. When there is a change in mode, the display device 10 may be operated in the first mode, at S120.

In this case, a valid image may be displayed on the second pixel area AA2, a black image may be displayed on the first sub-pixel area SB1 of the first pixel area AA1, and a dummy image may be displayed on the second sub-pixel area SB2 of the first pixel area AA1.

Furthermore, a black image may be displayed on the third sub-pixel area SB3 of the third pixel area AA3, and a dummy image may be displayed on the fourth sub-pixel area SB4 of the third pixel area AA3.

The method of displaying the dummy images on the second and fourth sub-pixel areas SB2 and SB4 has been illustrated above; therefore, further description thereof may not be repeated.

While the display device 10 is operated in the first mode, act S130 of determining whether to change the mode may be performed.

At S130, when the display device 10 is removed from the wearable device 30 or there is a request from the user, the mode of the display device 10 may be changed.

When there is no change in mode, the first mode may be continuously performed. When there is a change in mode, the display device 10 may be operated in the second mode, at S140.

Various embodiments of the present disclosure may provide a display device having improved display quality, and a method of driving the display device.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

In addition, it will also be understood that when a layer is referred to as being "between" two layers or areas, it can be the only layer or area between the two layers or areas, or one or more intervening layers or areas may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art. Further, a specific quantity or range recited in this written description or the claims may also encompass the inherent variations in measured or calculated values that would be recognized by those of ordinary skill in the art.

As used herein, the terms "use," "using," and "used" may be considered synonymous with the terms "utilize," "utilizing," and "utilized," respectively.

The display device and/or any other relevant devices or components, such as the timing controller, the scan drivers, the data driver, and the light emitting drivers, according to embodiments of the present invention described herein may be implemented utilizing any suitable hardware, firmware (e.g. an application-specific integrated circuit), software, or a suitable combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

Example embodiments have been disclosed herein, and although specific terms are employed, they are used and are to be interpreted in a generic and descriptive sense and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various suitable changes in form and details may be made without departing from the spirit and scope of the present disclosure as defined by the following claims, and equivalents thereof.

What is claimed is:

1. A display device comprising:

a first pixel area comprising first pixels;

a second pixel area comprising second pixels; and a display driver configured to control image display operations of the first pixel area and the second pixel area according to a first mode or a second mode, wherein the first pixel area comprises a first sub-pixel area, and a second sub-pixel area between the first sub-pixel area and the second pixel area, wherein the display driver is configured to display a valid image via the second pixel area in the first mode, and to display a valid image via the first pixel area and the second pixel area in the second mode, and wherein, in the first mode, to prevent a boundary between the first sub-pixel area and the second pixel area from being visible to a user, at least a portion of the second sub-pixel area is to repeatedly perform a light-emitting operation in a first period and a non-light-emitting operation in a second period while the second pixel area displays the valid image during both of the first and second periods.

2. The display device according to claim 1, wherein the second sub-pixel area comprises a first pixel group and a second pixel group, each of which comprises some of the first pixels, and wherein the first pixel group and the second pixel group are to alternately emit light in the first mode.

3. The display device according to claim 2, wherein the first pixel group and the second pixel group are included in one pixel row of the first pixels.

4. The display device according to claim 1, wherein the second sub-pixel area is to repeatedly perform, in the first mode, the light-emitting operation and the non-light-emitting operation on an at least one horizontal line basis.

5. The display device according to claim 4, wherein, in the first mode, an entire portion of the second sub-pixel area is to repeatedly perform the light-emitting operation and the non-light-emitting operation.

6. The display device according to claim 4, wherein the first pixels of the second sub-pixel area are to emit light and then to sequentially perform the non-light-emitting operation on an at least one pixel row basis in the first mode.

7. The display device according to claim 6, wherein the first pixels of the second sub-pixel area are to perform the non-light-emitting operation in a sequence from a pixel row farthest from the second pixel area to a pixel row closest to the second pixel area in the first mode.

8. The display device according to claim 1, wherein the second sub-pixel area comprises a first pixel group and a second pixel group, each of which comprises first pixel units, wherein each of the first pixel units comprises some of the first pixels, and wherein the first pixel group and the second pixel group are to alternately emit light in the first mode.

9. The display device according to claim 8, wherein each of the first pixel units comprises one first pixel configured to emit red light, one first pixel configured to emit blue light, and two first pixels configured to emit green light from among the first pixels.

10. The display device according to claim 8, wherein each of the first pixel units comprises one first pixel configured to emit red light, one first pixel configured to emit green light, and two first pixels configured to emit blue light from among the first pixels.

11. The display device according to claim 1, wherein, in the first mode, the first sub-pixel area is to display a black image and the second sub-pixel area is to display a dummy image.

12. The display device according to claim 11, wherein a luminance of the dummy image is reduced in discrete levels in a direction away from the second pixel area.

13. The display device according to claim 1, wherein, in the first mode, a boundary between the first sub-pixel area and the second pixel area is not visible by the light-emitting operation and the non-light-emitting operation of at least the portion of the second sub-pixel area.

14. The display device according to claim 1, further comprising:

a third pixel area comprising third pixels, wherein the second pixel area is between the first pixel area and the third pixel area.

15. The display device according to claim 14, wherein the third pixel area comprises a third sub-pixel area, and a fourth sub-pixel area between the third sub-pixel area and the second pixel area, wherein, in the first mode, the third sub-pixel area is to display a black image, and the fourth sub-pixel area is to display a dummy image, and wherein, in the first mode, at least a portion of the fourth sub-pixel area is to repeatedly perform the light-emitting operation in the first period and the non-light-emitting operation in the second period.

16. The display device according to claim 1, wherein the first pixel area comprises a plurality of first pixel areas at a side of the second pixel area.

17. A method of driving a display device, the method comprising:

displaying, in a second mode, a valid image via a first pixel area comprising first pixels and a second pixel area comprising second pixels; and displaying, in a first mode, a black image via a first sub-pixel area of the first pixel area, and a dummy image via a second sub-pixel area of the first pixel area between the first sub-pixel area and the second pixel area, wherein, in the first mode, to prevent a boundary between the first sub-pixel area and the second pixel area from being visible to a user, at least a portion of the second sub-pixel area repeatedly performs a light-emitting operation in a first period and a non-light-emitting operation in a second period while the second pixel area displays the valid image during both of the first and second periods.

18. The method according to claim 17, wherein the second sub-pixel area comprises a first pixel group and a second pixel group, each of which comprises some of the first pixels, and wherein the first pixel group and the second pixel group are to alternately emit light in the first mode.

19. The method according to claim 17, wherein the second sub-pixel area is to repeatedly perform, in the first mode, a light-emitting operation and a non-light-emitting operation on an at least one horizontal line basis.

20. The method according to claim 17, wherein a luminance of the dummy image is reduced in discrete levels in a direction away from the second pixel area.

* * * * *